US007218058B2

(12) United States Patent
Sagawa et al.

(10) Patent No.: US 7,218,058 B2
(45) **Date of Patent: *May 15, 2007**

(54) COLD CATHODE TYPE FLAT PANEL DISPLAY

(75) Inventors: Masakazu Sagawa, Inagi (JP); Toshiaki Kusunoki, Tokorozawa (JP); Mutsumi Suzuki, Kodaira (JP); Nobuaki Kabuto, Kunitachi (JP)

(73) Assignee: Hitachi, Ltd., Tokyo (JP)

( * ) Notice: Subject to any disclaimer, the term of this patent is extended or adjusted under 35 U.S.C. 154(b) by 119 days.

This patent is subject to a terminal disclaimer.

(21) Appl. No.: 11/076,952

(22) Filed: Mar. 11, 2005

(65) Prior Publication Data

US 2005/0156533 A1 Jul. 21, 2005

Related U.S. Application Data

(63) Continuation of application No. 10/648,196, filed on Aug. 27, 2003, now Pat. No. 6,963,171.

(30) Foreign Application Priority Data

Dec. 20, 2002 (JP) ..... 2002-369177
Aug. 8, 2003 (JP) ..... 2003-206692

(51) Int. Cl.
*G09G 3/10* (2006.01)

(52) U.S. Cl. ..... 315/169.1; 315/169.3; 315/169.4; 345/75.2; 345/80; 345/905; 313/306; 313/310

(58) Field of Classification Search .. 315/169.1–169.4; 345/74.1–75.2, 80, 905; 313/306, 309–311; 445/24, 25

See application file for complete search history.

(56) References Cited

U.S. PATENT DOCUMENTS

| | | | | |
|---|---|---|---|---|
| 5,760,538 | A | 6/1998 | Mitsutake | |
| 5,912,531 | A | 6/1999 | Hasegawa | |
| 6,184,610 | B1 | 2/2001 | Shibata | |
| 6,225,749 | B1 | 5/2001 | Kobayashi | |
| 6,274,972 | B1 | 8/2001 | Mitsutake | |
| 6,278,233 | B1 | 8/2001 | Sanou | |
| 6,366,014 | B1 * | 4/2002 | Kuroda et al. | 313/495 |
| 6,409,566 | B1 | 6/2002 | Hasegawa | |

(Continued)

FOREIGN PATENT DOCUMENTS

JP 7-29527 1/1995

(Continued)

*Primary Examiner*—Haissa Philogene
(74) *Attorney, Agent, or Firm*—Antonelli, Terry, Stout & Kraus, LLP.

(57) ABSTRACT

A cold cathode type flat panel display which is an image display device including a vacuum panel container composed of a cathode substrate in which plural cold cathode type electron sources are arranged, an anode substrate, plural spacers for supporting the cathode substrate and the anode substrate, and a glass frame. Plural electrical lines extend in a line direction and a row direction across an interlayer insulator on the cathode substrate. Parts of lines positioned in an upper layer of the plural electrical lines are made into scan lines and lines positioned in a lower layer are made into data lines. Further, parts of the electrical lines positioned in the upper layer are made into ground lines for giving ground voltage to the spacers.

5 Claims, 26 Drawing Sheets

U.S. PATENT DOCUMENTS

| | | | | |
|---|---|---|---|---|
| 6,873,115 | B2 * | 3/2005 | Sagawa et al. | 315/169.1 |
| 6,873,311 | B2 * | 3/2005 | Yoshihara et al. | 345/87 |
| 2002/0030640 | A1 | 3/2002 | Nomura et al. | |

FOREIGN PATENT DOCUMENTS

| | | | |
|---|---|---|---|
| JP | 10-153979 | * | 6/1998 |
| JP | 10-199455 | | 7/1998 |
| JP | 2002-208076 | | 7/2000 |
| JP | 2000208076 | | 7/2000 |
| JP | 2001-101965 | | 4/2001 |
| JP | 2001101965 | | 4/2001 |
| JP | 3305166 | | 5/2002 |
| KR | 2001003201 | | 1/2001 |
| WO | WO 02/05307 | | 1/2002 |

* cited by examiner

COLD CATHODE TYPE FLAT PANEL DISPLAY

CROSS REFERENCE TO RELATED APPLICATION

This is a continuation application of U.S. application Ser. No. 10/648,196, filed Aug. 27, 2003, now U.S. Pat. No. 6,963,171, the contents of which are incorporated herein by reference.

BACKGROUND OF THE INVENTION AND RELATED ART

The present invention relates to a cold cathode type flat panel display, in particular, a spontaneously emitting type flat panel display using cold cathode electron sources.

As known well, a cold cathode type flat panel display is a display that comprises a phosphor film which is formed on a flat panel and emits by electron excitation and very small cold cathode electron sources arranged in a two-dimensional matrix form so as to be opposed to the phosphor film, and that has a function of irradiating the phosphor film with electron rays emitted from the electron sources to display an image on the panel. Displays using such very small cold cathode electron sources which can be integrated are generically named field emission displays (FEDs).

Cold cathode electron sources are roughly classified to field emission type electron sources and hot electron type electron sources. Examples of the former include a spindt type electron source, a surface conduction type electron source, and a carbon nano-tube type electron source. Examples of the latter include a metal-insulator-metal (MIM) type electron source, wherein a metal, an insulator and a metal are laminated, and a metal-insulator-semiconductor (MIS) type electron source, wherein a metal, an insulator and a semiconductor are laminated.

The MIM type electron source is disclosed in, for example, Japanese Patent Application Laid-Open No. 2001-101965 (Patent Document 1) and Japanese Patent Application Laid-Open 2000-208076 (Patent Document 2). A structure of the MIM electron source and the operation principle thereof are shown in FIGS. 1 and 2.

FIG. 1 is a sectional structural view of an MIM type electron emitting element. In FIG. 1, bottom electrodes 11, made of, e.g., Al or Al alloy, are formed on an insulating cathode substrate 10 made of glass or the like so as to have a thickness of, e.g., 300 nm and be in a stripe form in the direction perpendicular to the surface of the drawing paper.

An interlayer insulator 14 (film thickness: e.g., 140 nm) for preventing the concentration of an electric field at edges of the bottom electrodes 11 and limiting or laying down an electron emission area, and a tunneling insulator 12 (film thickness: e.g., 10 nm) are formed.

Contact electrodes 15 and top electrode bus lines 16 are formed in a stripe form in the direction perpendicular to the bottom electrodes 11 (i.e., the right and left direction in the drawing paper), so as to avoid the electron emission area E. The electron emission area E corresponds to top electrodes 13 on the tunneling insulator 12. The top electrodes will be described in detail later.

The contact electrodes 15 are made of a metal film having a strong adhesive force to the cathode substrate 10 or the interlayer insulator 14, for example, a high melting point metal such as W (tungsten) or Mo (molybdenum) or a silicon compound thereof (silicide), so as to have a film thickness of, e.g., about 10 nm.

The top electrode bus lines 16 are bus lines which can be connected to the top electrodes 13, which will be detailed later, at a low resistance and are made of an Al—Nd alloy film, so as to have a thickness of 200 nm. In order to prevent the snapping of the top electrodes 13, which will be detailed later, it is desired that a metal film as an underlying layer 15A for the contact electrodes is made as thin as possible.

On the top electrode bus lines 16, the interlayer insulator 14 and the cathode substrate 10 except the electron emission area E, a surface protection film 17 is formed, which is an insulator film made of, for example, intrinsic silicone, $SiO_2$, glass (such as phosphor doped glass or boron doped glass), $Si_3N_4$ (nitride), $Al_2O_3$ (alumina) or polyimide. For reference, in the case of using $Si_3N_4$, the film thickness thereof is from 0.1 to 1 μm.

The tunneling insulator 12 is covered with top electrodes 13. The top electrodes 13 have a three-layer structure composed of a lower layer made of Ir (iridium), which is good in heat resistance, an intermediate layer made of Pt (platinum) and an upper layer made of Au (gold), which is good in electron emitting efficiency, and are applied onto the tunneling insulator 12 in a thin film forming step using, for example, sputtering.

In this thin film forming step, the layer of the top electrodes 13 is simultaneously deposited on the surface of the surface protection film 17. As shown in FIG. 1, however, the layer of the top electrode bus lines 16 retreats inwards from end faces of the surface protection film 17 so that the surface protection film 17 is made into the form of eaves. Consequently, a metal film 13' on the surface protection film 17 is electrically insulated from the top electrodes 13 on the tunneling insulator 12.

When a voltage Vd is applied between the bottom electrodes 11 and the top electrodes 13 of the MIM type electron emitting element having a structure as described above in vacuum, electrons, in the bottom electrodes 11, having an energy level near the Fermi level penetrate through a potential barrier by tunneling phenomena, so as to be injected into the conduction band of the tunneling insulator 12 and the top electrodes 13. As a result, hot electrons are generated. Among these electrons, electron having a kinetic energy equal to or more than the work function Φ of the top electrodes 13 are emitted into the vacuum.

A document related to such a technique is Japanese Patent Application Laid-Open No. 2001-83907 (Patent Document 3).

FIG. 46 is a sectional view illustrating an outline of a display panel in the prior art. As illustrated in this figure, in order to use the above-mentioned MIM type electron sources to construct a display device, the cathode electrode 10 wherein the electron sources having the structure illustrated in FIG. 1 are arranged in a matrix form and an anode substrate 110 wherein phosphor film pieces 111 are arranged in a matrix form so as to correspond to the electron source elements of the cathode substrate 10 are adhered through a glass frame member 116 made of glass or the like by junction based on frit glass 115, thereby making an inner space 118 into vacuum. In this way, a display panel (flat panel display) 120 is yielded. As will be described in more detail later, the anode substrate 110 is made of a light-transmitting flat panel, and the whole of a single surface of the anode substrate 110, including the surfaces of the phosphor film pieces 111, is covered with a conductive film (called a metal back) 114.

When the diagonal size of the display panel 120 is more than 5 inches in this case, it is necessary to insert spacers 30 made of an insulator material, as reinforcing materials, at intervals of several centimeters into the inner space (vacuum atmosphere) of the panel in order to keep the atmospheric pressure.

A part of electrons emitted from the electron source elements collides with these spacers 30, so that the spacers 30 are charged up. Near the charged spacers, the orbit of the electrons is curved so as to cause a phenomenon that an image is distorted. In order to prevent this phenomenon, a slight conductivity is given to the surface of the spacers 30 by means of a high-resistance film made of tin oxide, a mixed crystal thin film made of tin oxide and indium oxide, a metal film, a semiconductor film or some other film. In this way, the electrification of the spacer surfaces is removed.

It is therefore necessary to connect the spacers 30 electrically to the metal back 114 on the side of the anode substrate 110 and the top electrodes 13' on the surface protection film 17 on the side of the cathode substrate 10. The top electrodes 13' for giving grounding voltage on the side of the cathode substrate 10 have a thickness of 10 nm or less and further have a weak adhesive force to the surface protection film 17; therefore, when pressure from the spacers is applied to the top electrodes 13', the snapping or breaking down thereof is easily caused. In order to prevent this, it is necessary to set third bus lines independently of the data lines (the top electrode bus lines 16 and the scan lines (the bottom electrodes 11), as ground lines 18 for the spacers 30, on the surface protection film 17.

However, in the case of adopting the three-layer line structure wherein the data lines 16, the scan lines 11 and the third bus lines independently thereof are set on the side of the cathode substrate 10 as described above, the production process thereof unavoidably becomes longer than the production process including the formation of two-layer bus lines. As a result, problems of a drop in the yield or an increase in the production costs are caused.

OBJECTS AND SUMMARY OF THE INVENTION

Accordingly, an object of the present invention is to solve the above-mentioned problems and provide a cold cathode type flat panel display (specifically, a hot electron type cold cathode type flat panel display) comprising a cathode substrate which has a two-layer structure but substantially has ground lines for spacers which can be inexpensively produced.

As a result of various experiments and examinations, the inventors have obtained the finding that the above-mentioned problems can be solved by taking the following measurements: a cathode substrate which has a two-layer line structure but substantially has ground lines, for spacers, having a stable structure can be realized by contriving its line structure as follows:

(1) Hitherto, bottom electrodes, which are first layer (lower layer) lines used as scan lines, are made into data lines (conventional scan lines are converted to data lines), and
(2) Spacer lines and scan lines made of second layer lines (top electrode bus lines) are formed so as to display an image according to a line sequential scanning scheme (conventional data lines are converted to scan lines).

First, by the item (1), the scan data and the spacer lines can be extended in the same direction. In addition, the second lines are used to make the scan lines and the spacer lines from the same layer.

Questions may be put up to the practicability of the above-mentioned line structure. However, the present invention has a sufficient basis.

In general, the shape of each of pixels is a square. A scan line pitch corresponds to the length of each side of this square. The pitch of data lines is ⅓ of the length since each of the pixels includes three colors, that is, red (R), green (G) and blue (B). Specifically, for example, in a WXGA (resolution: 720×1200 dots) having a diagonal size of 32 inches, the scan data pitch thereof and the data line pitch thereof are 550 μm and 183 μm, respectively.

Since the thickness of ordinary spacers themselves is from about 100 to 200 μm, it can be said that the structure of the present invention, wherein spacers and ground lines for the spacers are inserted between scan lines having a wide pitch, is a reasonable design.

When the above is summarized, the following conclusion can be obtained: by adopting the present invention, lines composed of three layers in the conventional cathode substrate 10 are unified into lines composed of two layers; accordingly, the interlayer insulator present between the third lines and the second lines in the cathode substrate 10 becomes unnecessary.

As described above, according to the present invention, the line structure of its cathode substrate is changed from the three-layer line structure in the prior art to a two-layer line structure and further ground lines for its spacers are formed, as the same layer as is made up to top electrode bus lines which constitute scan lines, on the same flat surface. Therefore, the line structure is simple and further the top electrode bus lines and the ground lines for the spacers can be produced in the same step. As a result, the production process of the display of the present invention can be shortened and an improvement in the yield thereof and a drop in the production costs thereof can be attained.

Figure 1:
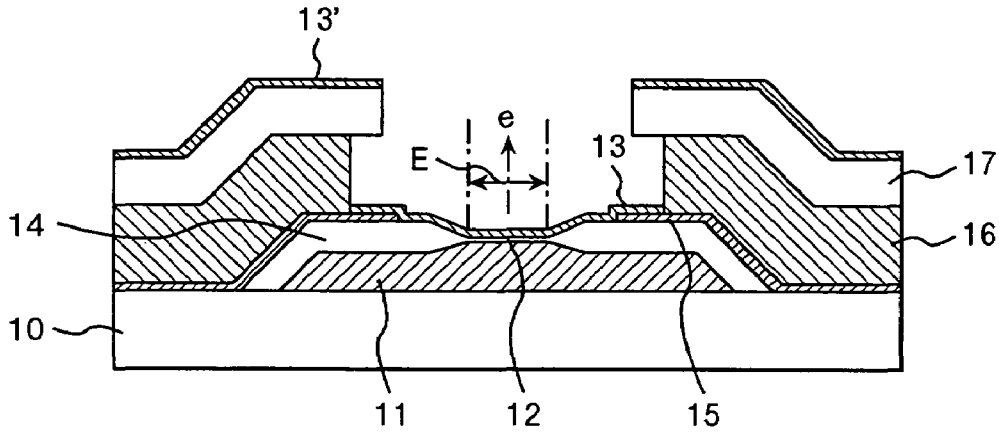
FIG. 1 is a view illustrating an MIM type electron source in the prior art.
Figure 2:
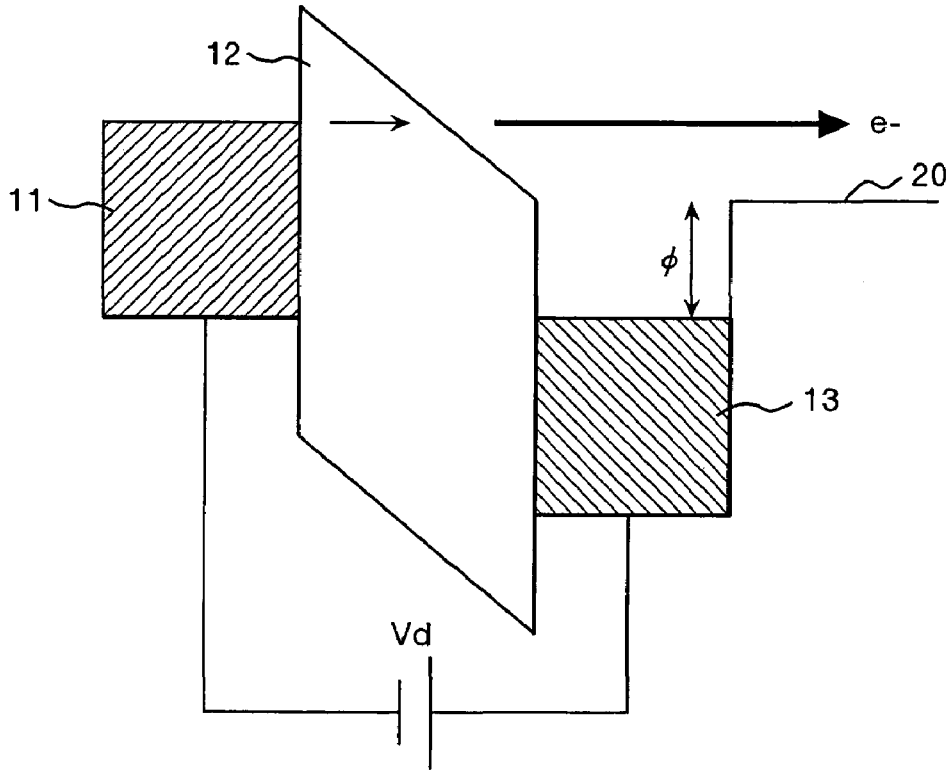
FIG. 2 is a view illustrating the operation principle of the MIM type electron source.

Reference numbers in the above-mentioned drawings are as follows.

10: cathode substrate, 11: bottom electrode (data line), 12: tunneling insulator, 13 and 13': top electrode, 14: interlayer insulator, 15: contact electrode, 16: top electrode bus line (scan line), 16': spacer line, 17: surface protection film, 18: spacer ground line, 20: vacuum level, 30: spacer, 40: data line driver circuit, 50: scan line driver circuit, 60: high voltage generating circuit, 70: flexible printed circuit (FPC), 110: anode substrate, 111: red phosphor, 112: green phosphor, 113: blue phosphor, 114: metal back, 115: frit glass, 115': conductive frit glass, 116: glass frame, 117: black matrix, 118: vacuum, 120: display panel, E: electron emission area, and e: emitted electron.

DETAILED DESCRIPTION OF PREFERRED EMBODIMENTS

A first aspect of the present invention is typically a cold cathode type flat panel display which is an image display device comprising a vacuum panel container composed of a cathode substrate in which plural cold cathode type electron sources are arranged at regular intervals, an anode substrate in which a phosphor film is deposited in the form of dots or lines so as to be opposed to the electron sources, plural spacers for supporting the cathode substrate and the anode substrate at a given interval, and a glass frame.

Plural electrical lines which extend in a line direction and a row direction which cross each other are formed, across an interlayer insulator, on the cathode substrate; the cold cathode type electron sources are arranged at positions corresponding to intersection coordinates of these electrical lines so as to be connected to the electrical lines in the line direction and the row direction; and the cold cathode type electron sources are line-sequentially scanned, thereby displaying images.

In this image display device, some parts of lines positioned in the upper layer out of the plural electrical lines are made into scan lines and lines positioned in the lower layer out of the plural electrical lines are made into data lines, and some parts of the electrical lines positioned in the upper layer are made into ground lines for giving ground voltage to the spacers, and further the spacers are in a ground state by the ground lines at the least in the period when the scan lines adjacent thereto are selected.

A second aspect of the present invention is typically a cold cathode type flat panel display which is an image display device comprising a vacuum panel container composed of a cathode substrate in which plural cold cathode type electron sources are arranged at regular intervals, an anode substrate in which a phosphor film is deposited in the form of dots or lines so as to be opposed to the electron sources, plural spacers for supporting the cathode substrate and the anode substrate at a given interval, and a glass frame.

Plural electrical lines which extend in a line direction and a row direction which cross each other are formed, across an interlayer insulator, on the cathode substrate; the cold cathode type electron sources are arranged at positions corresponding to intersection coordinates of these electrical lines so as to be connected to the electrical lines in the line direction and the row direction; and the cold cathode type electron sources are line-sequentially scanned, thereby displaying images.

In this image display device, lines positioned in the upper layer out of the plural electrical lines are made into scan lines and lines positioned in the lower layer out of the plural electrical lines are made into data lines, and some parts of the scan lines positioned in the upper layer function both as power feeding lines for giving electric potential to the spacers and scan lines, and are at scan line voltage at the least in the period when the parts of the scan lines are selected.

A third aspect of the present invention is as follows: in the cold cathode type flat panel display according to the first or second aspect, in an edge portion of the cathode substrate, terminals of the electrical lines positioned in the upper layer are connected to a flexible printed circuit (abbreviated to FPC) connected to a scan line driver circuit, and supply electric potential to the spacer lines through the scan line driver circuit.

A fourth aspect of the present invention is as follows: in the cold cathode type flat panel display according to the first aspect, in an edge portion of the cathode substrate, terminals of the electrical lines positioned in the upper layer are connected to a flexible printed circuit connected to a scan line driver circuit, and supply ground voltage from the outside through independent power feeding lines in the state that the spacer lines are mutually short-circuited through internal lines of the flexible printed circuit.

A fifth aspect of the present invention is as follows: in the cold cathode type flat panel display according to the first aspect, the spacer lines in the edge portion of the cathode substrate are extended to the outside of terminals of the scan lines and are mutually short-circuited, and the spacer lines give ground voltage from the outside through independent power feeding lines.

A sixth aspect of the present invention is as follows: in the cold cathode type flat panel display according to any one of the first to fifth aspects, the cold cathode type electron sources each have a structure wherein a bottom electrode, an electron accelerator, and a top electrode are laminated in this order, and are each an electron source element which emits electrons from the surface of the top electrode when a positive voltage is applied to the top electrode.

A seventh aspect of the present invention is as follows: in the cold cathode type flat panel display according to the sixth aspect, the bottom electrode of each of the cold cathode type electron sources is made of Al or Al alloy, and the electron accelerator is made of alumina obtained by subjecting the Al or Al alloy to anodic oxidation.

EXAMPLES

An example of the present invention will be specifically described with reference to the attached drawings hereinafter.

Example 1

An example according to the first aspect of the present invention will be described with reference to FIGS. 3 to 33.

(1) Formation of a Cathode Substrate 10:

This item describes a production process in a case in which top electrodes 13 are connected electrically to contact electrodes 15 and further top electrode bus lines 16 are backed with aluminum, aluminum alloy, or a metal having a lower resistivity than aluminum.

It is beforehand stated that the MIM electron source producing process which can be used in the present invention is not limited to the present example. The present invention can easily be applied to MIM electron sources disclosed in Patent Documents 1 and 2 (Japanese Patent Application Laid-Open Nos. 2001-101965 and 2000-208076), which comprise top electrode bus lines having a tapered structure, and other MIM electron sources.

Figure 3:
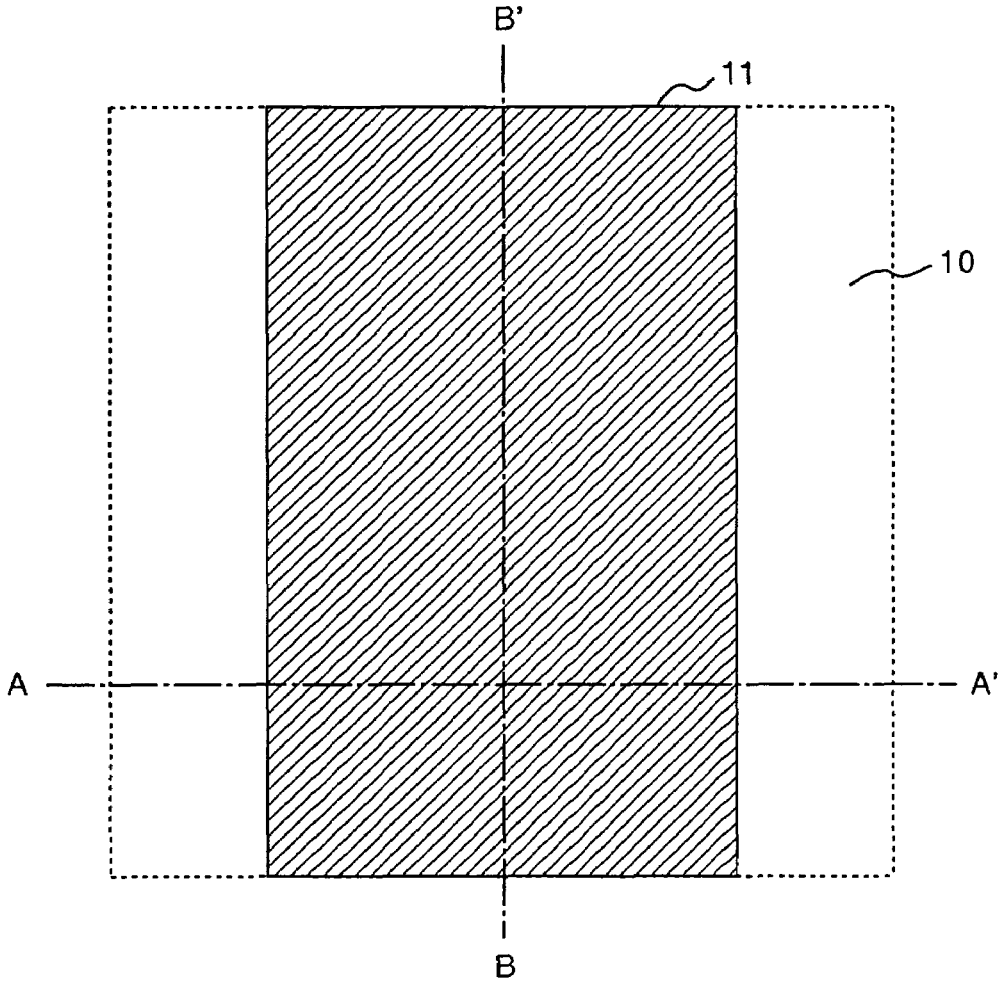
FIG. 3 is a plan view illustrating the step of forming a bottom electrode 11 in the production of an MIM type electron source of the present invention.
Figure 4:
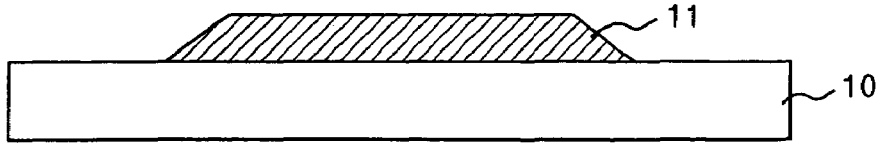
FIG. 4 is a sectional view of the members illustrated in FIG. 3, taken on line A–A', in the production of the MIM type electron source of the present invention.
Figure 5:
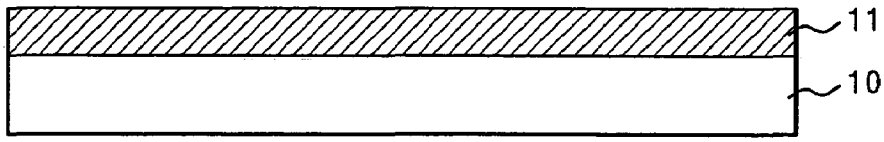
FIG. 5 is a sectional view of the members illustrated in FIG. 3, taken on line B–B', in the production of the MIM type electron source of the present invention.

First, a metal film for bottom electrodes 11 is deposited on an insulating cathode substrate 10 made of glass or the like. As the material for the bottom electrode, Al or Al alloy is used. Actually, Al—Nd doped with 2% by atom of Nd was used. For the formation of the metal film, for example, sputtering is used. Actually, the film thickness thereof was set to 300 nm. After the formation of the metal film, the bottom electrodes 11, in a stripe form as illustrated in FIG. 3 (a plan view), FIG. 4 (a sectional view taken on line A–A'), and FIG. 5 (a sectional view taken on line B–B') are formed through a photolithographic step and an etching step. In the etching step, there is used, for example, wet etching based on an aqueous mixed solution of phosphoric acid, acetic acid and nitric acid.

Figure 6:
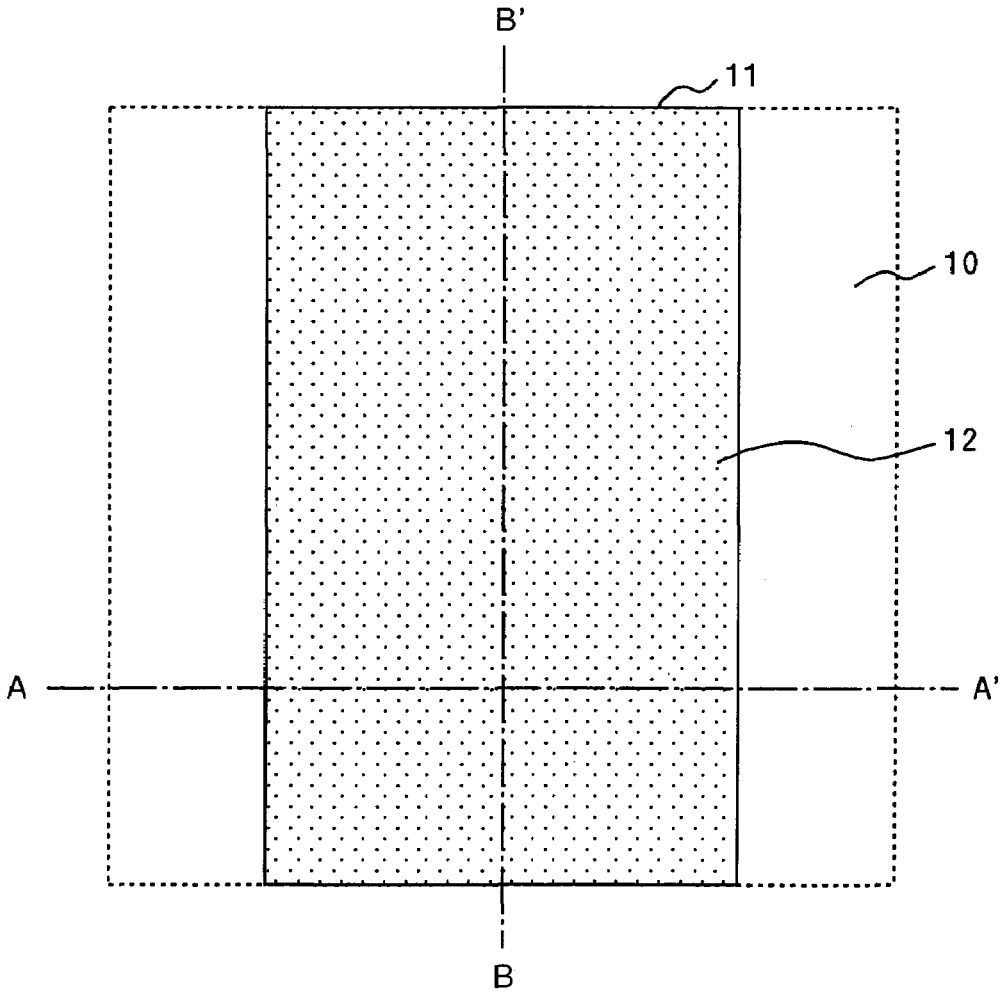
FIG. 6 is a plan view illustrating the step of forming a tunneling insulator 12 on the bottom electrode 11 in the production of the MIM type electron source of the present invention.
Figure 7:
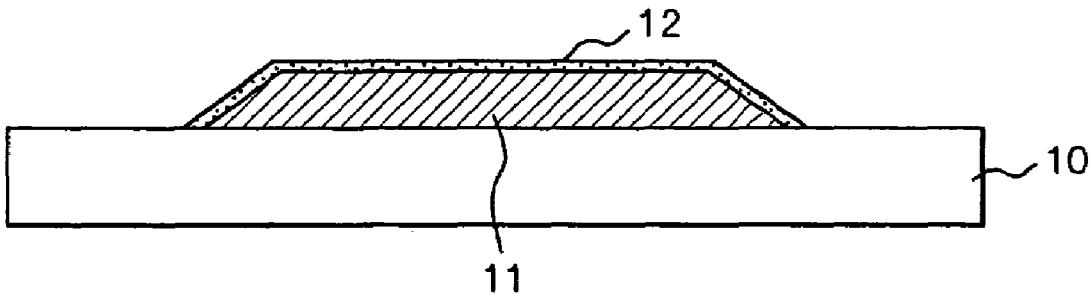
FIG. 7 is a sectional view of the members illustrated in FIG. 6, taken on line A–A', in the production of the MIM type electron source of the present invention.
Figure 8:
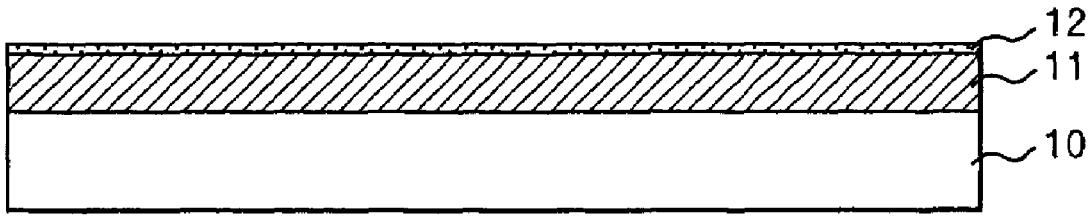
FIG. 8 is a sectional view of the members illustrated in FIG. 6, taken on line B–B', in the production of the MIM type electron source of the present invention.

As illustrated in FIG. 6 (a plan view), FIG. 7 (a sectional view taken on line A–A'), and FIG. 8 (a sectional view taken on line B–B'), the surfaces of the bottom electrodes 11 are subjected to anodic oxidation. For example, when the formation voltage is set to 6V, an insulator layer 12 having a thickness of about 10 nm is formed on the bottom electrodes 11.

Figure 9:
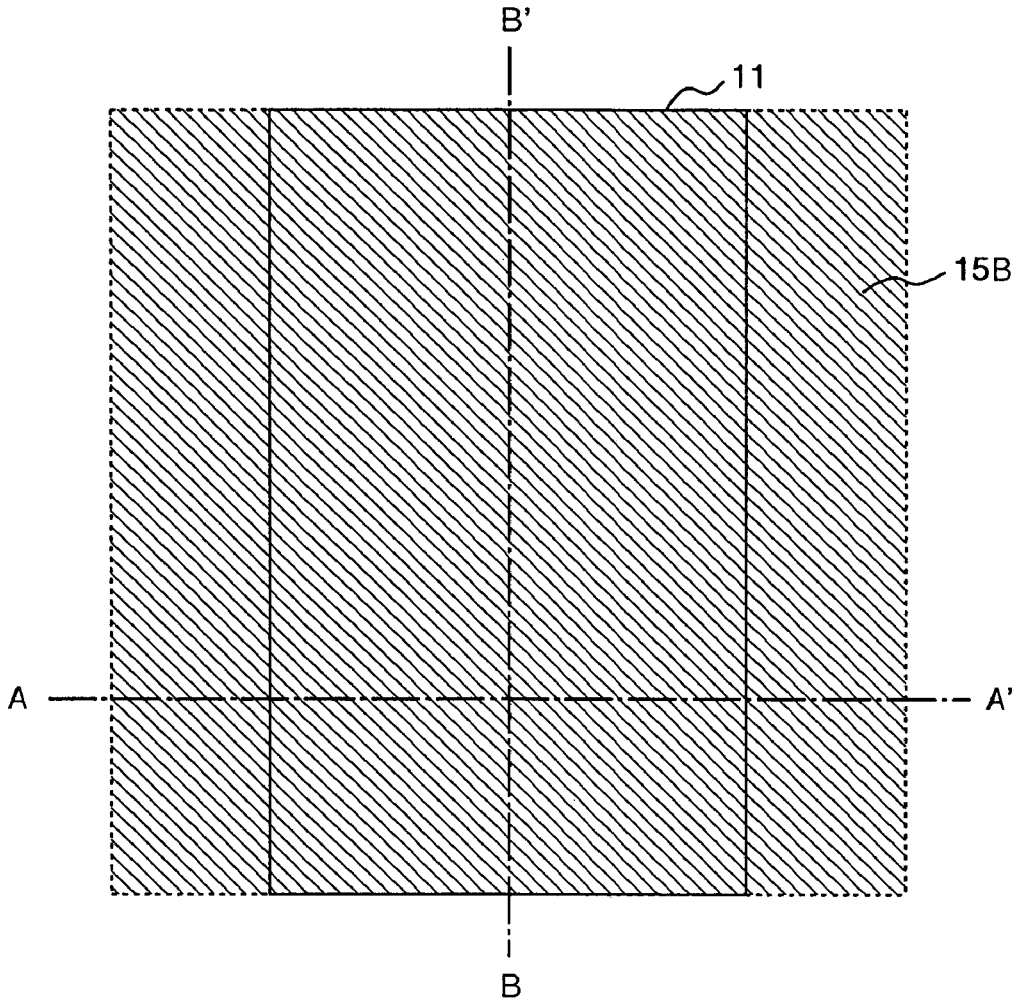
FIG. 9 is a plan view illustrating the step of forming contact electrodes 15A and 15B in the production of the MIM type electron source of the present invention.
Figure 10:
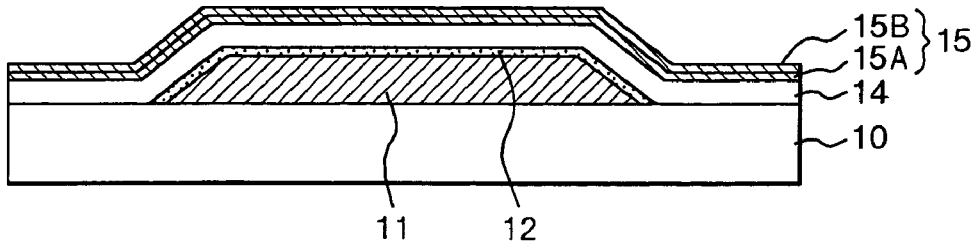
FIG. 10 is a sectional view of the members illustrated in FIG. 9, taken on line A–A', in the production of the MIM type electron source of the present invention.
Figure 11:
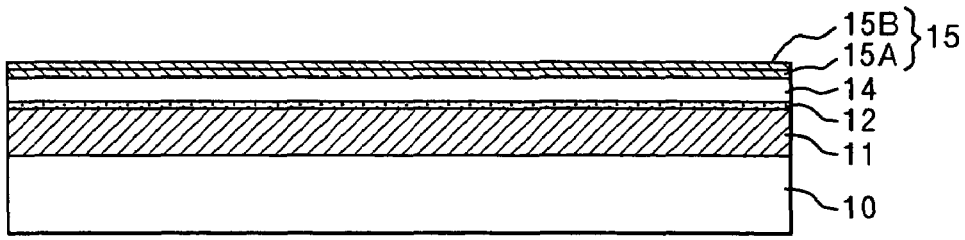
FIG. 11 is a sectional view of the members illustrated in FIG. 9, taken on line B–B', in the production of the MIM type electron source of the present invention.

As illustrated in FIG. 9 (a plan view), FIG. 10 (a sectional view taken on line A–A'), and FIG. 11 (a sectional view taken on line B–B'), $Si_3N_4$ for an interlayer insulator 14, Cu for an upper contact electrode layer 15B, which will be a seed film for plating, and Cr for a lower contact electrode layer 15A for ensuring adhesiveness between Cu and the underlying thereof are continuously deposited by sputtering. The lower contact electrode layer 15A is made as thin as about several ten nanometers in such a manner that the snapping of top electrodes 13, which will be formed later, will not be caused by difference in level in the lower contact electrode layer 15A. The film thickness of the upper contact electrode layer 15B is not particularly limited. However, the film thickness is set in such a manner that the lower contact electrode layer 15A will not elute out at the time of plating treatment.

Figure 12:
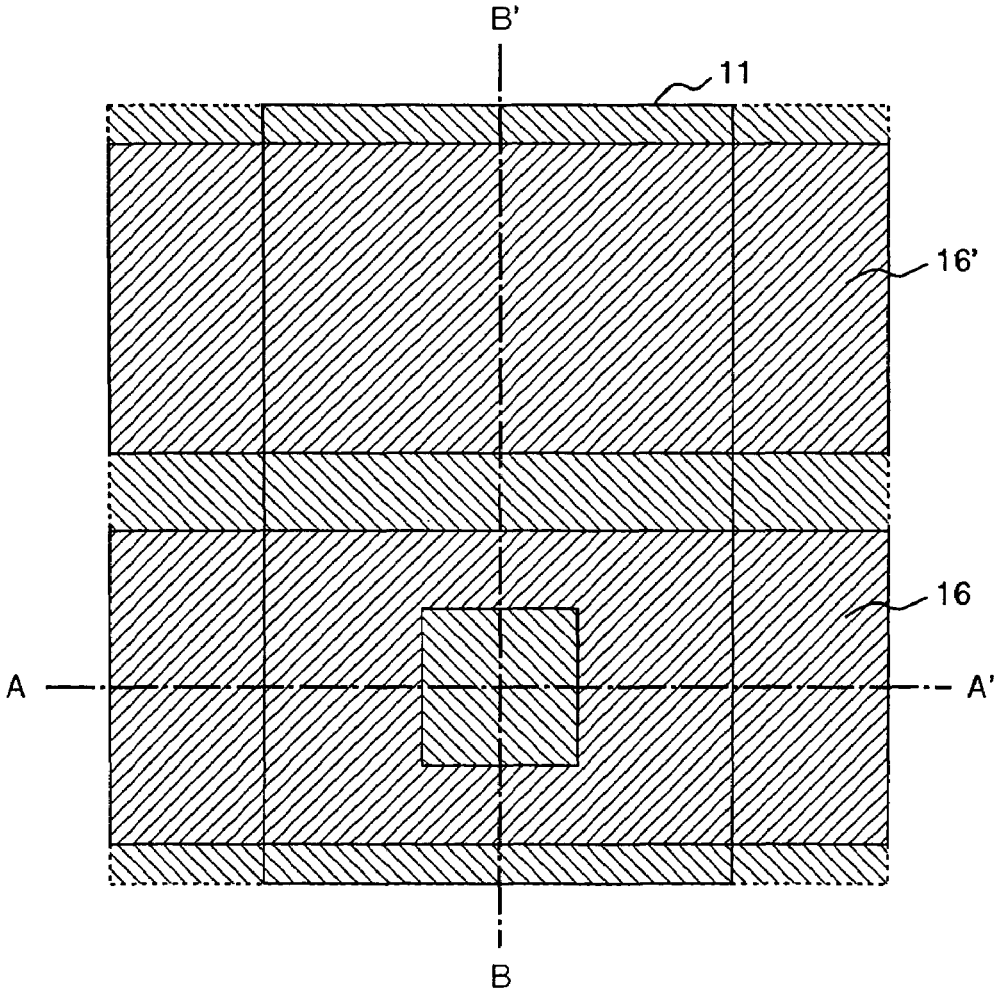
FIG. 12 is a plan view illustrating the step of forming top electrode bus lines 16 and spacer lines 16' in the production of the MIM type electron source of the present invention.
Figure 13:
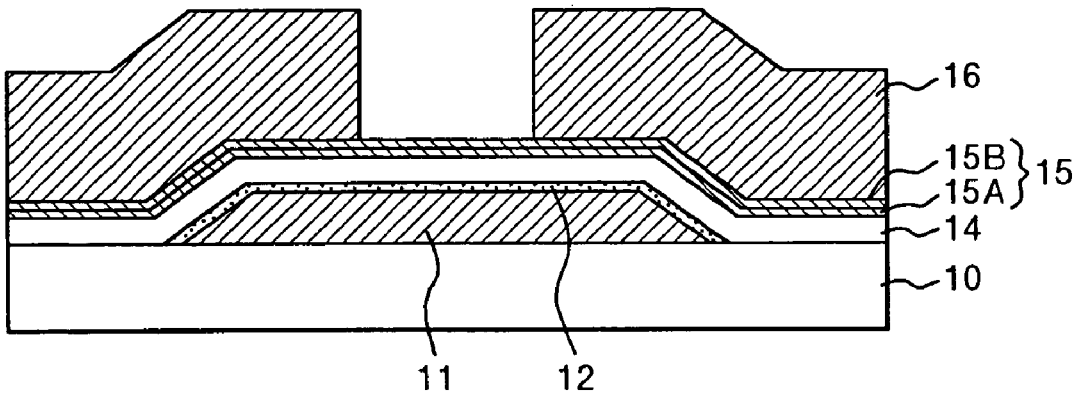
FIG. 13 is a sectional view of the members in FIG. 12, taken on line A–A', in the production of the MIM type electron source of the present invention.
Figure 14:
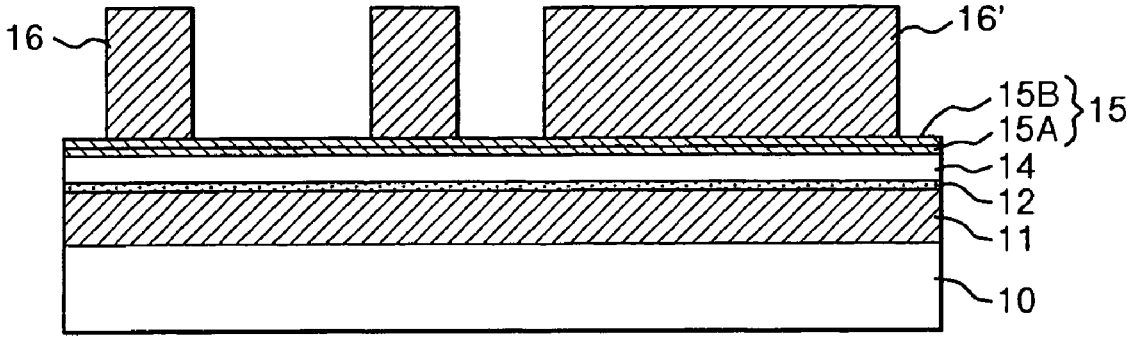
FIG. 14 is a sectional view of the members in FIG. 12, taken on line B–B', in the production of the MIM type electron source of the present invention.

As illustrated in FIG. 12 (a plan view), FIG. 13 (a sectional view taken on line A–A'), and FIG. 14 (a sectional view taken on line B–B'), resist patterns as plating masks are given to the upper contact electrode layer 15B, and subsequently Cu is thickly deposited by electroplating or electroless plating, so as to form top electrode bus lines 16 made of Cu and having a thickness of, e.g., 5 μm (in the figures, the lines 16 are drawn in the state that the thickness thereof is scaled down for appearance' sake).

Any one of these figures illustrates the state after the thickly plating of Cu is completed and then the plating masks (resist patterns) are removed. The resist patterns are of two kinds, one of which is a square pattern for forming an electron emission area for electron sources, and the other of which is a stripe-form pattern for dividing areas which will be the top electrode bus lines 16 and spacer lines 16'.

Figure 15:
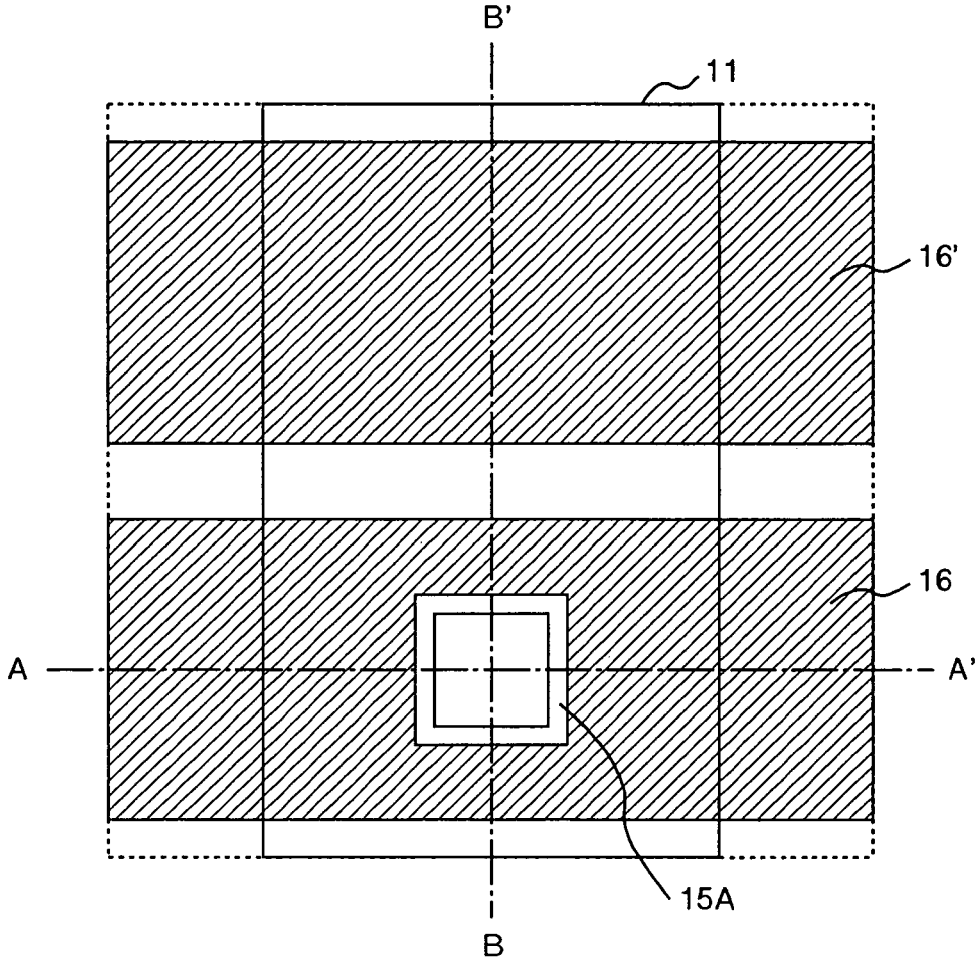
FIG. 15 is a plan view illustrating the step of producing the MIM type electron source of the present invention.
Figure 16:
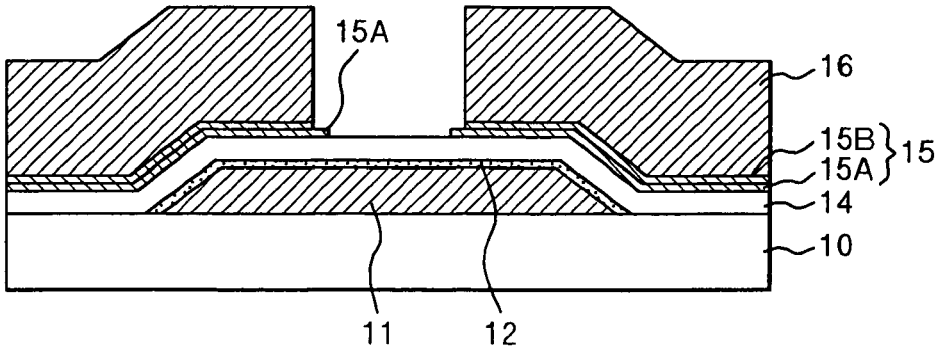
FIG. 16 is a sectional view of the members illustrated in FIG. 15, taken on line A–A', in the step of producing the MIM type electron source of the present invention.
Figure 17:
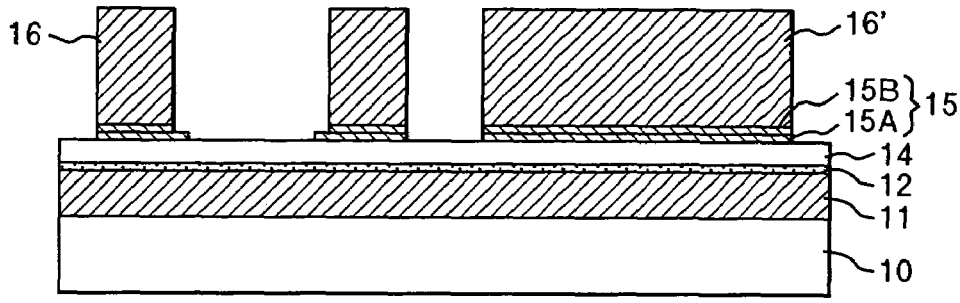
FIG. 17 is a sectional view of the members illustrated in FIG. 15, taken on line B–B', in the step of producing the MIM type electron source of the present invention.

As illustrated in FIG. 15 (a plan view), FIG. 16 (a sectional view taken on line A–A'), and FIG. 17 (a sectional view taken on line B–B'), Cu in the entire surface is etched to work the thin upper contact electrode layer 15B into a stripe form in the direction perpendicular to the bottom electrodes 11. Since the upper contact electrode layer 15B is far thinner than the top electrode bus lines 16, only the upper contact electrode layer 15B can be selectively removed by controlling the time for the etching. As the etchant, for example, an aqueous mixed solution of phosphoric acid, acetic acid and nitric acid (PAN) is suitable.

Subsequently, a resist pattern in the form of a square frame is formed on the lower contact electrode layer 15A for forming the electron emission area (square concave portion) for electron sources. The lower contact electrode layer 15A (Cr) naked inside the frame-form pattern is selectively worked by wet etching, so as to be removed. For the wet etching of Cr, an aqueous solution of cerium diammonium nitrate is suitable. Attention should be paid to the matter that the frame-form resist pattern is formed to cover the peripheral end of the lower contact electrode layer 15A, as described above. In this way, top electrodes 13, which will be formed later, will overlap with the lower contact electrode layer 15A without breaking off so as to be connected to the layer 15A.

Figure 18:
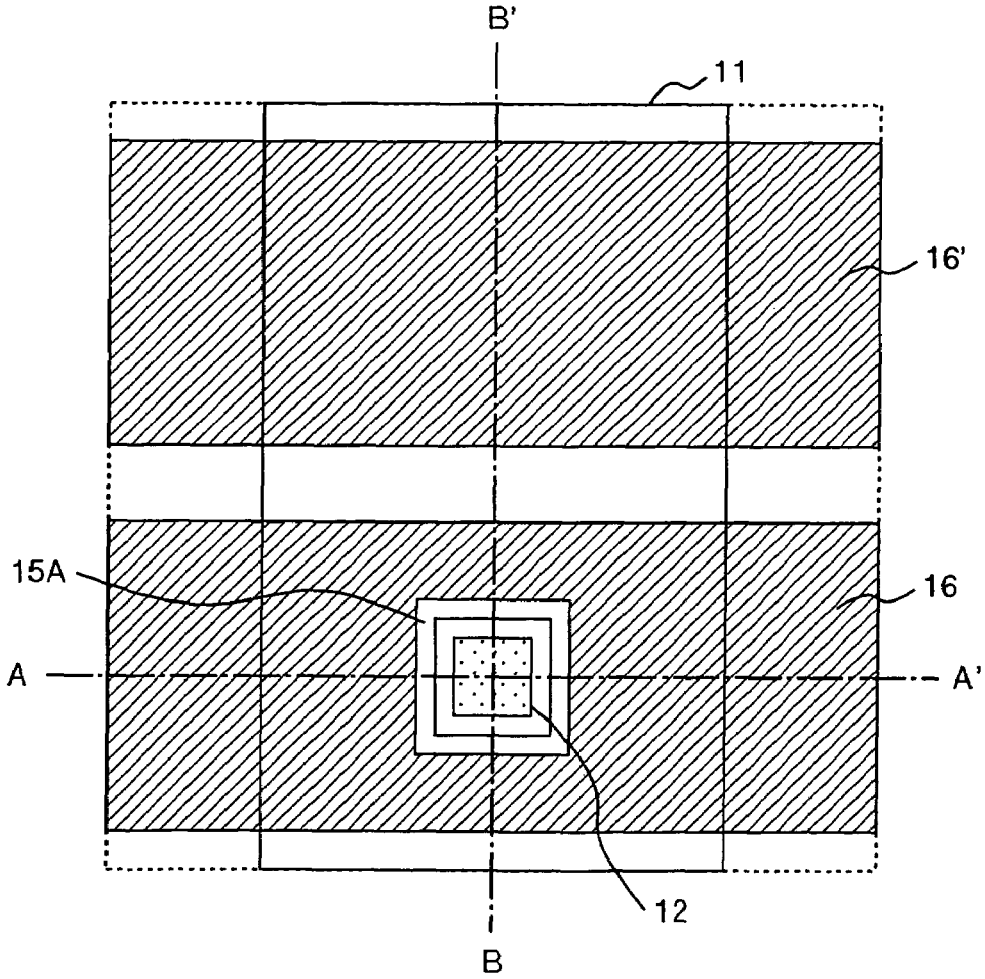
FIG. 18 is a plan view illustrating the step of producing the MIM type electron source of the present invention.
Figure 19:
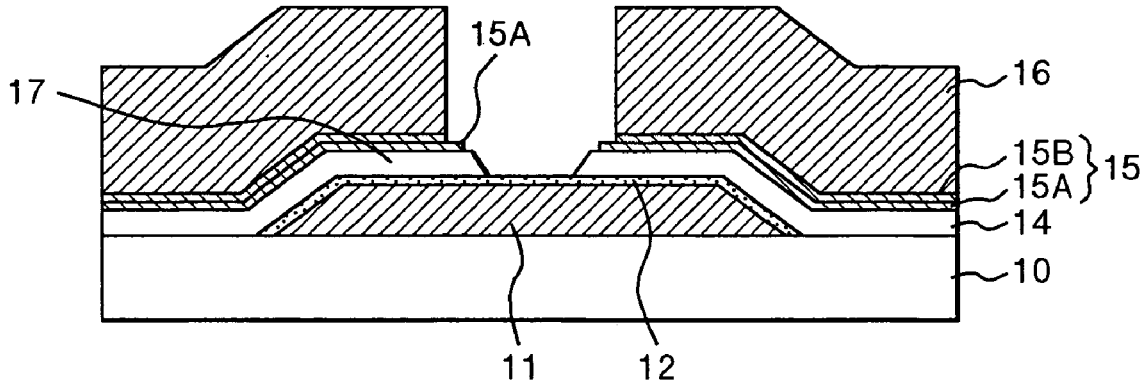
FIG. 19 is a sectional view of the members illustrated in FIG. 18, taken on line A–A', in the step of producing the MIM type electron source of the present invention.
Figure 20:
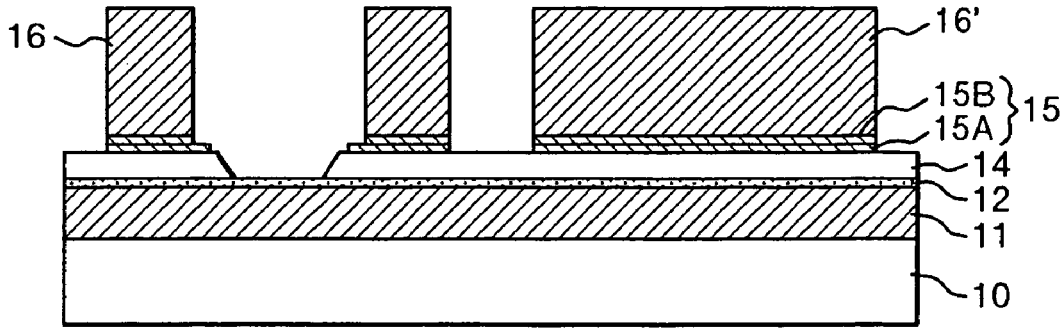
FIG. 20 is a sectional view of the members illustrated in FIG. 18, taken on line B–B', in the step of producing the MIM type electron source of the present invention.

As illustrated in FIG. 18 (a plan view), FIG. 19 (a sectional view taken on line A–A'), and FIG. 20 (a sectional view taken on line B–B'), a hole is made in a part of the interlayer insulator 14 by photolithography and dry etching in order to open the electron emission area in the concave portion which will make the electron emission area for electron sources. In this way, a tunneling insulator 12 is made naked. For the etching gas, a mixed gas of $CF_4$ and $O_2$ is suitable. The naked tunneling insulator 12 is again subjected to anodic oxidation to repair work-damage based on the etching.

Figure 21:
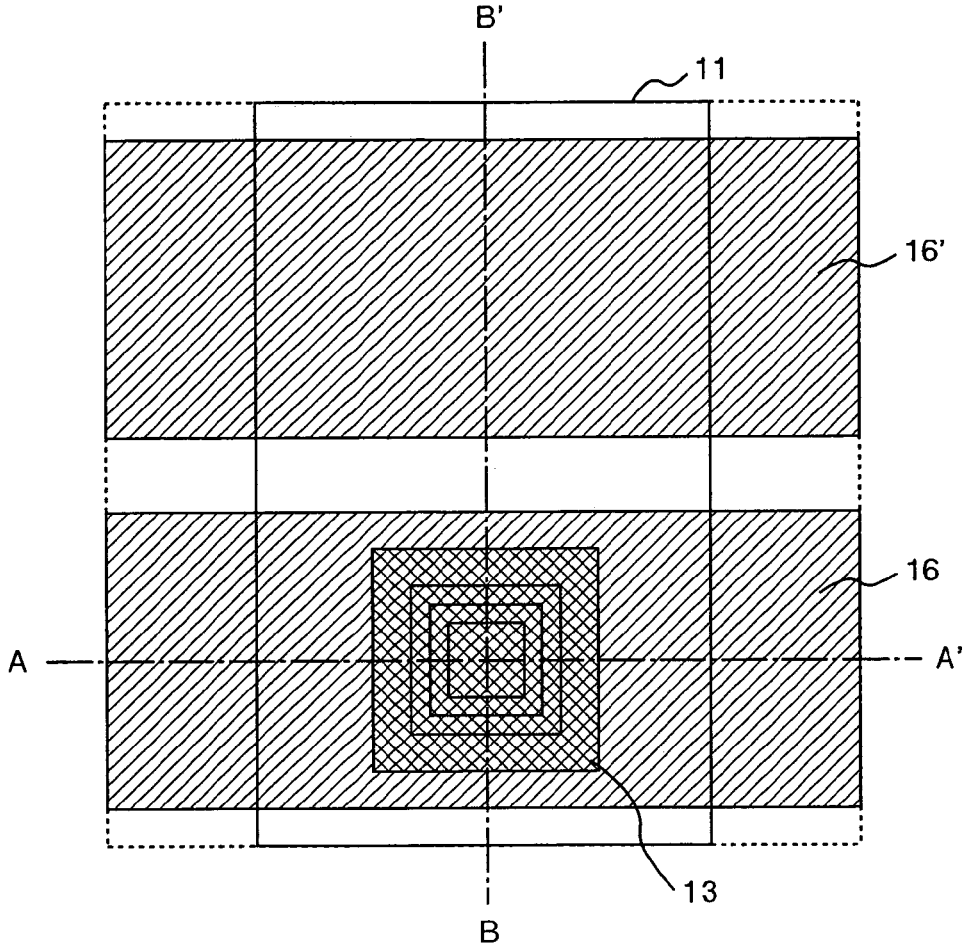
FIG. 21 is a plan view illustrating the step of producing the MIM type electron source of the present invention.
Figure 22:
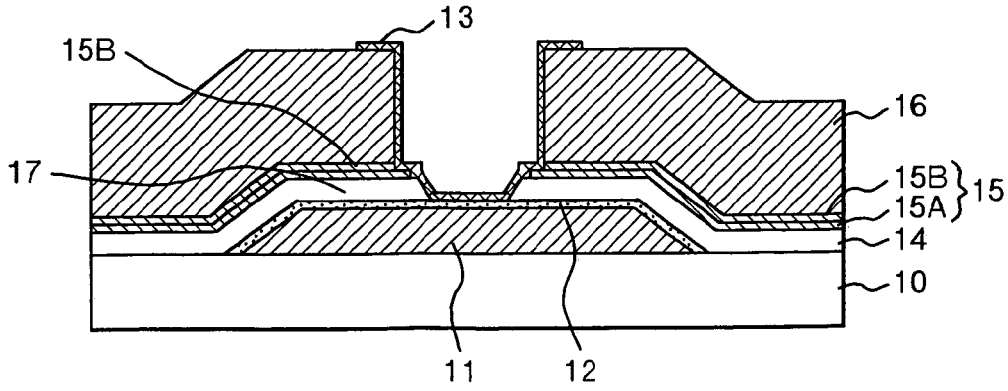
FIG. 22 is a sectional view of the members illustrated in FIG. 21, taken on line A–A', in the step of producing the MIM type electron source of the present invention.
Figure 23:
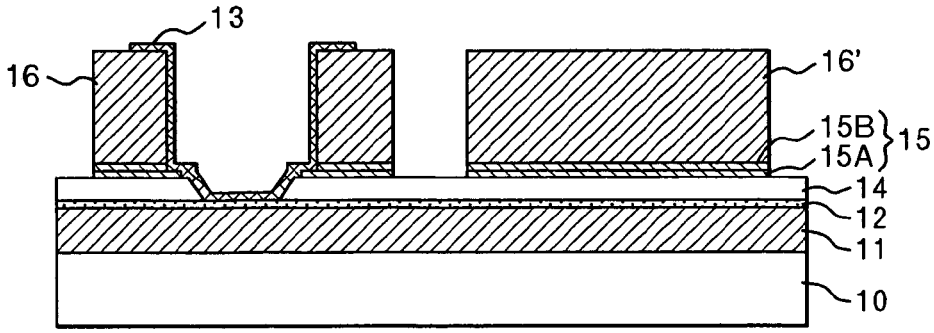
FIG. 23 is a sectional view of the members illustrated in FIG. 21, taken on line B–B', in the step of producing the MIM type electron source of the present invention.

As illustrated in FIG. 21 (a plan view), FIG. 22 (a sectional view taken on line A–A'), and FIG. 23 (a sectional view taken on line B–B'), top electrodes 13 are formed to complete an electron source substrate (finished cathode substrate 10). The formation of the film for the top electrodes 13 is performed by sputtering using a shadow mask. In this way, the top electrode bus lines 16 are separated from each other.

As the material for the top electrodes 13, the above-mentioned laminated films of Ir, Pt and Au are used. The film thickness of each of the films is set to several nanometers. This makes it possible to avoid damage to the top electrodes or the tunneling insulator, associated with the photolithography and etching.

The following will describe a process for producing the whole of a display device, using the MIM type electron source substrate (finished cathode substrate 10).

First, a cathode substrate wherein plural MIM type electron sources are arranged on the cathode substrate 10 is formed in accordance with the above-mentioned production process.

Figure 24:
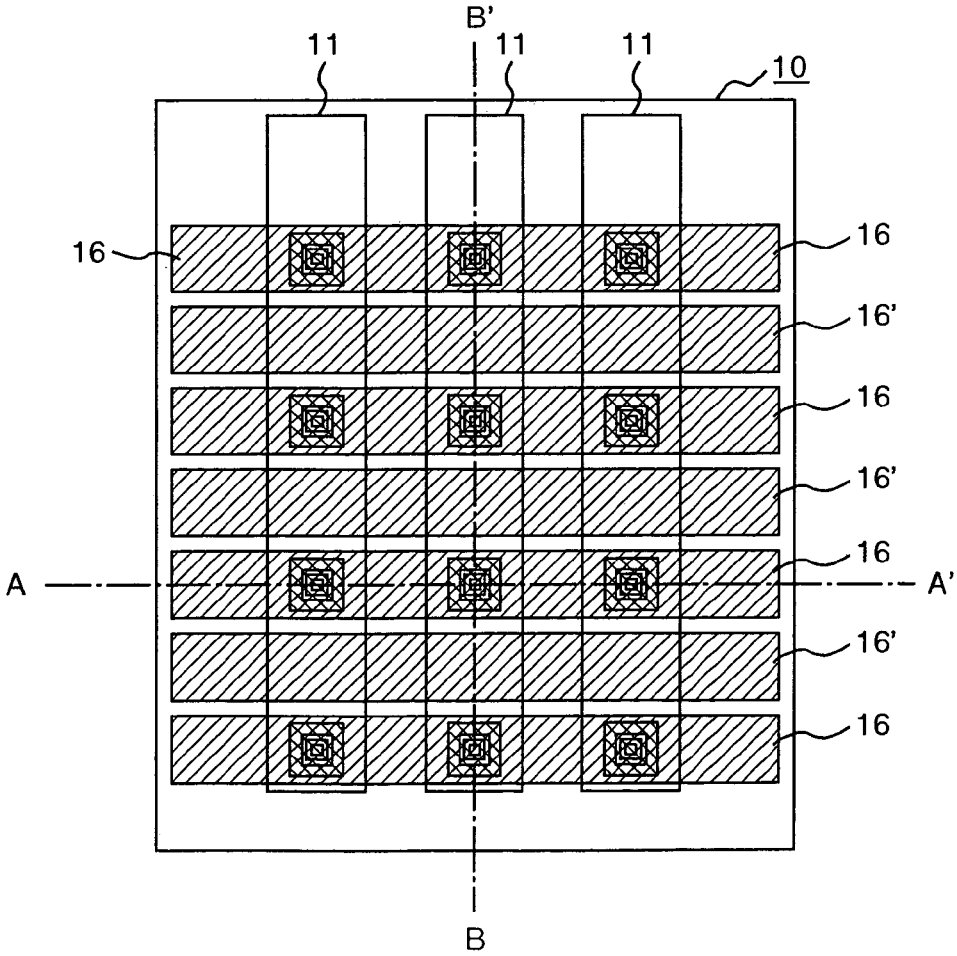
FIG. 24 is a plan view of a cathode substrate 10 of the present invention.
Figure 25:
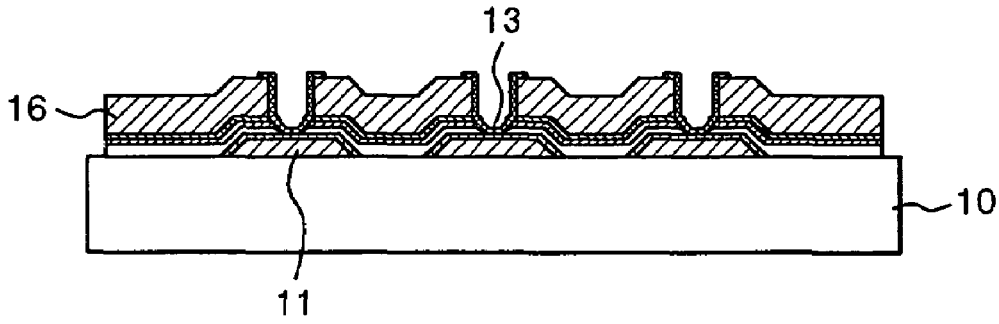
FIG. 25 is a sectional view of the cathode substrate 10 of the present invention, taken on line A–A' of FIG. 24.
Figure 26:
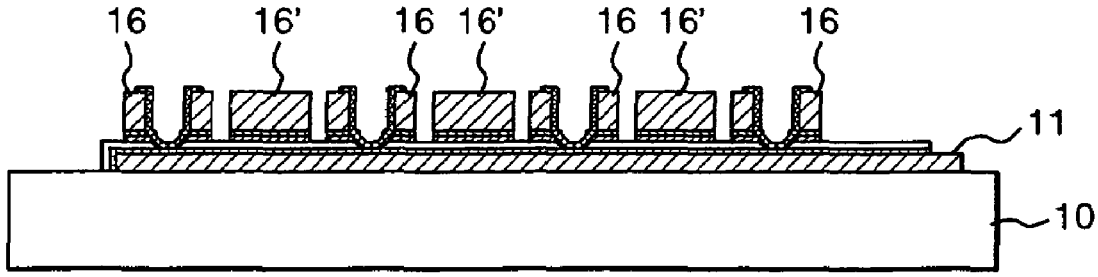
FIG. 26 is a sectional view of the cathode substrate 10 of the present invention, taken on line B–B' of FIG. 24.

To simplify the description hereinafter, a plan view and sectional views of the cathode substrate 10 which is a 3×4 dot MIM type electron source substrate are shown in FIG. 24 (a plan view), FIG. 25 (a sectional view taken on line A–A'), and FIG. 26 (a sectional view taken on line B–B'). Actually, an MIM type electron source matrix wherein the number of MIM type electron sources corresponds to the number of display dots should be formed.

In the case that a display device is constructed, electrode ends of the bottom electrodes 11 and the top electrode bus lines 16 must be made naked in order to connect the ends to driver circuits although this matter has not been referred to, in the description on the process for producing the MIM type electron source, hereinbefore.

Figure 27:
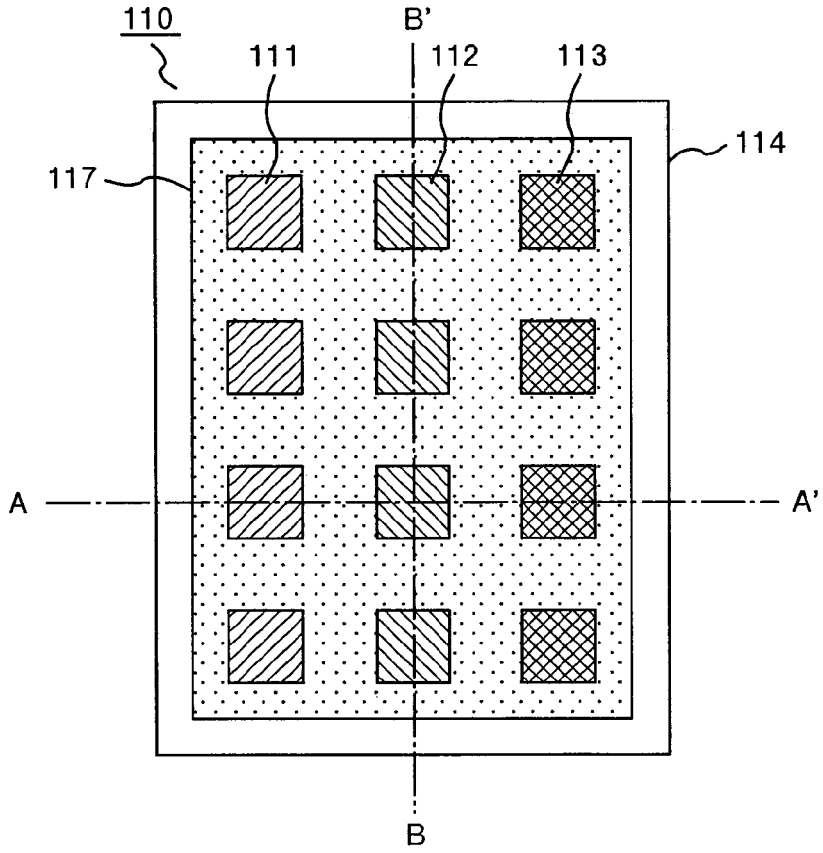
FIG. 27 is a plan view illustrating the production process of an anode substrate 110 using MIM type electron sources of the present invention.

(2) Formation of an Anode Substrate 110:

Referring to FIG. 27 (a plan view), FIG. 28 (a sectional view taken on line A–A'), and FIG. 29 (a sectional view taken on line B–B'), a process for producing an anode substrate 110 will be described.

As the anode substrate 110, light-transmitting glass is used. First, a black matrix 117 is formed in order to raise the contrast of the display device to be produced. The black matrix 117 is formed by applying a solution wherein polyvinyl alcohol (PVA) and ammonium chromate are mixed to the anode substrate 110, irradiating the portion other than the portion where the black matrix 117 is to be formed with ultra-violet rays so as to be sensitized, removing the non-sensitized portion, applying a solution where graphite powder is dissolved thereto, and then lifting off PVA.

Next, a red phosphor 111 is formed. An aqueous solution wherein phosphor particles are mixed with PVA and ammonium chromate is applied onto the anode substrate 110, and then the portion where the phosphor is to be formed is irradiated with ultra-violet rays so as to be sensitized, and then the non-sensitized portion is removed with flowing water. In this way, the red phosphor 111 is patterned.

Figure 28:
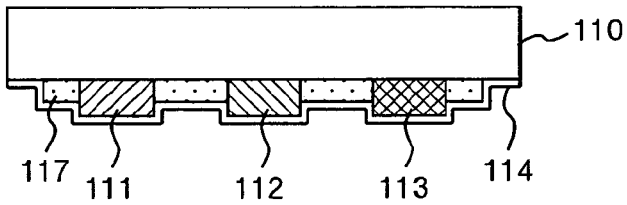
FIG. 28 is a sectional view illustrating the production process of the anode substrate 110 using the MIM type electron sources of the present invention, taken on line A–A' of FIG. 24.
Figure 29:
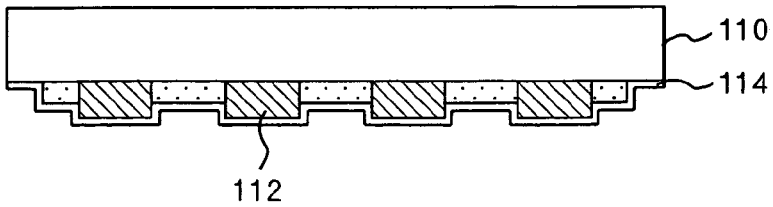
FIG. 29 is a sectional view illustrating the production process of the anode substrate 110 using the MIM type electron sources of the present invention, taken on line B–B' of FIG. 24.

The pattern is made into a dot-form pattern as illustrated in FIGS. 27, 28 and 29. In the same way, a green phosphor 112 and a blue phosphor 113 are formed. About the phosphors, it is advisable to use $Y_2O_2S$:Eu (P22-R) for the red, ZnS:Cu or Al (P22-G) for the green, and ZnS:Ag (P22-B) for the blue.

Next, the resultant is filmed with a film made of nitrocellulose or the like, and subsequently Al is vapor-deposited on the anode substrate 110 so as to have a thickness of about 75 nm, thereby forming a metal back 114. This metal back 114 functions as an accelerating electrode. Thereafter, the anode substrate 110 is heated to about 400° C. in the atmosphere to heat-decompose organic substances, such as the filming film or PVA. In this way, a finished anode substrate 110 is yielded.

(3) Formation of a Display Panel:

The finished anode substrate 110 and the finished cathode substrate 10, formed as described above, are adhered to a surrounding glass frame 116 through spacers 30 with frit glass 115.

Figure 30:
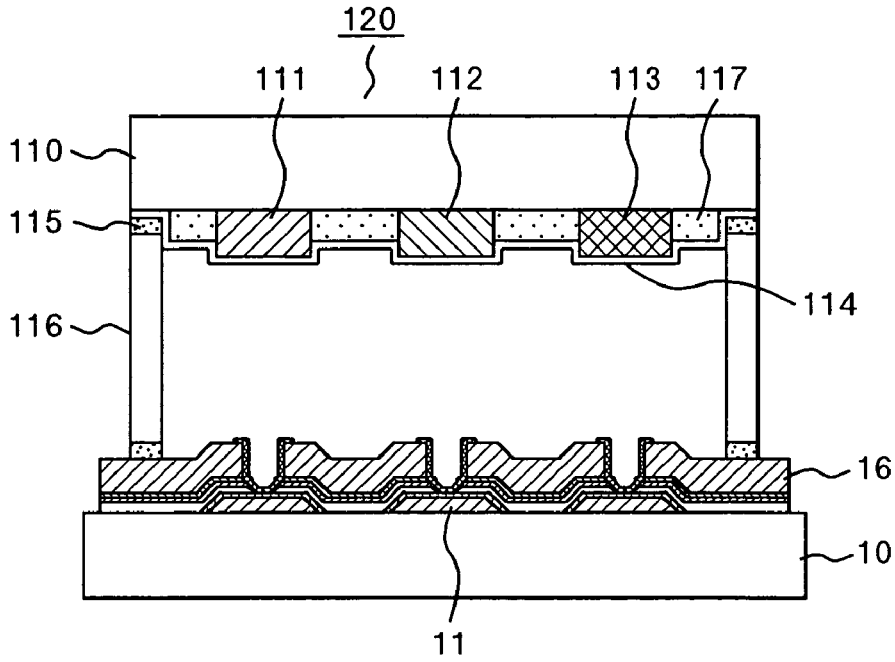
FIG. 30 is a sectional view illustrating the production process of a display device using the MIM type electron sources of the present invention, taken on line A–A' similar to the line in the cathode substrate 10.
Figure 31:
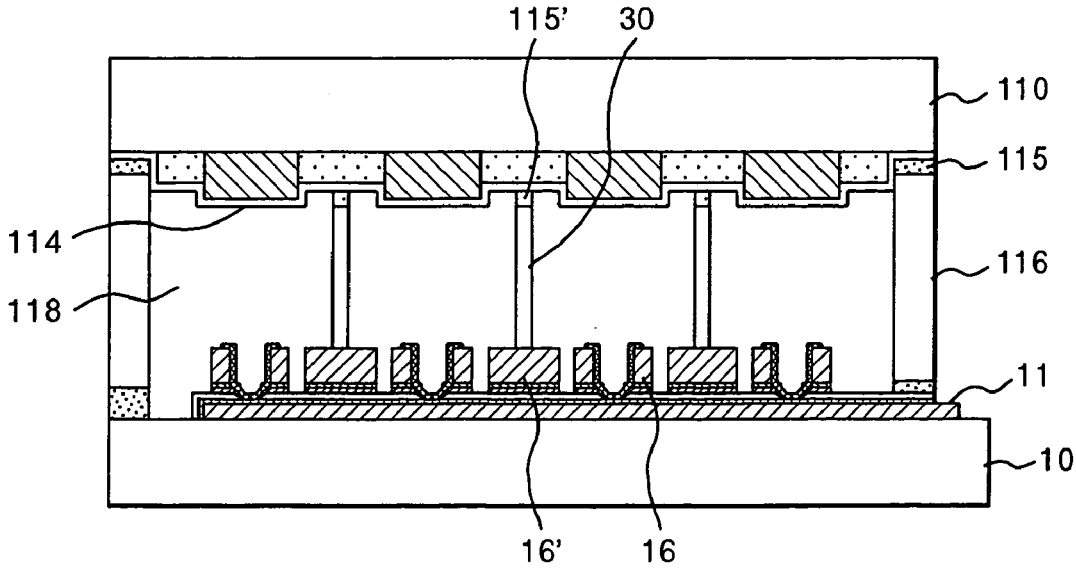
FIG. 31 is a sectional view illustrating the production process of a display device using the MIM type electron sources of the present invention, taken on line B–B' similar to the line in the cathode substrate 10.

FIG. 30 illustrates a section of a display panel 120 obtained by the adhesion, this section corresponding to the section taken on line A–A', and FIG. 31 illustrates a section of the display panel 120, this section corresponding to the section taken on line B–B'. The section taken on line A–A' and the section taken on line B–B' of the display panel correspond to line A–A' and line B–B' in cases where the cathode substrate 10 and the anode substrate 110 are drawn, respectively.

The height of the spacers 30 is set in such a manner that the distance between the anode substrate 110 and the cathode substrate 10 will be from about 1 to 3 mm. The spacers 30 are made of glass or ceramic in the form of a plate. Electrical conductivity is given at least to the surface of the glass or ceramic. One-side ends of the spacer 30 are arranged on the spacer lines 16' adjacent to the top electrode bus lines 16, and they are electrically connected to each other.

The other-side ends of the spacers 30 are arranged beneath the black matrix 117 on the display substrate side (the side of the anode substrate 110), and are fixed with an adhesive material such as conductive frit glass 115'. Therefore, the spacers 30 do not hinder light emission from the phosphors. Electrical connection between each of the spacer 30 and the corresponding spacer line 16' is attained by inserting the spacer 30 between the cathode substrate 10 and the anode substrate 110 under pressure and then bringing one end thereof into contact with the spacer line 16', or may be attained by a conductive paste if necessary.

In the case that the spacers 30 are members obtained by coating an insulator such as glass or ceramic with a conductive material having electron conductivity as described above so as to set the sheet resistance to 1 E+10 to 1 E+13 Ω/square, or are conductive glass or ceramic obtained by giving electrical conductivity to such an insulator itself, the spacers 30 are preferably spacers having electron conductivity and a volume resistance of, e.g., 1 E+8 to 1 E+11 Ω·cm.

As illustrated in FIG. 31, in this example, the spacers 30 are caused to stand on the respective phosphor dots which emit red (R), green (G) and blue (B), that is, all of the spacer lines 16'. However, in actual display panels, the number (density) of the spacers 30 may be decreased within such a scope that necessary mechanical strength can be obtained. Roughly, the spacers 30 may be caused to stand at intervals of several centimeters.

Instead of the plate-form spacers 30, pillar type spacers or cross type spacers may be used in other examples. In such a case, a panel can be fabricated in the same or similar way.

The panel 120 the peripheral edge portion of which is sealed is degassed into a vacuum of $10^{-7}$ Torr in pressure so as to be sufficiently sealed up. After the sealing, a getter inside the panel is activated and the inside of the panel is kept in a high vacuum. For example, in the case of a getter material made mainly of Ba, a getter film can be formed by high frequency heating or the like. A non-evaporating type getter made mainly of Zr may be used. In this way, the finished display panel 120 using the MIM type electron sources is yielded.

As described above, in the present example, the distance between the anode substrate 110 and the cathode substrate 10 is as long as about 1 to 3 mm. Accordingly, the acceleration voltage applied to the metal back 114 can be made as high as 1 to 10 kV, thereby making it possible to use, as the phosphors, phosphors for a cathode ray tube.

Figure 32:
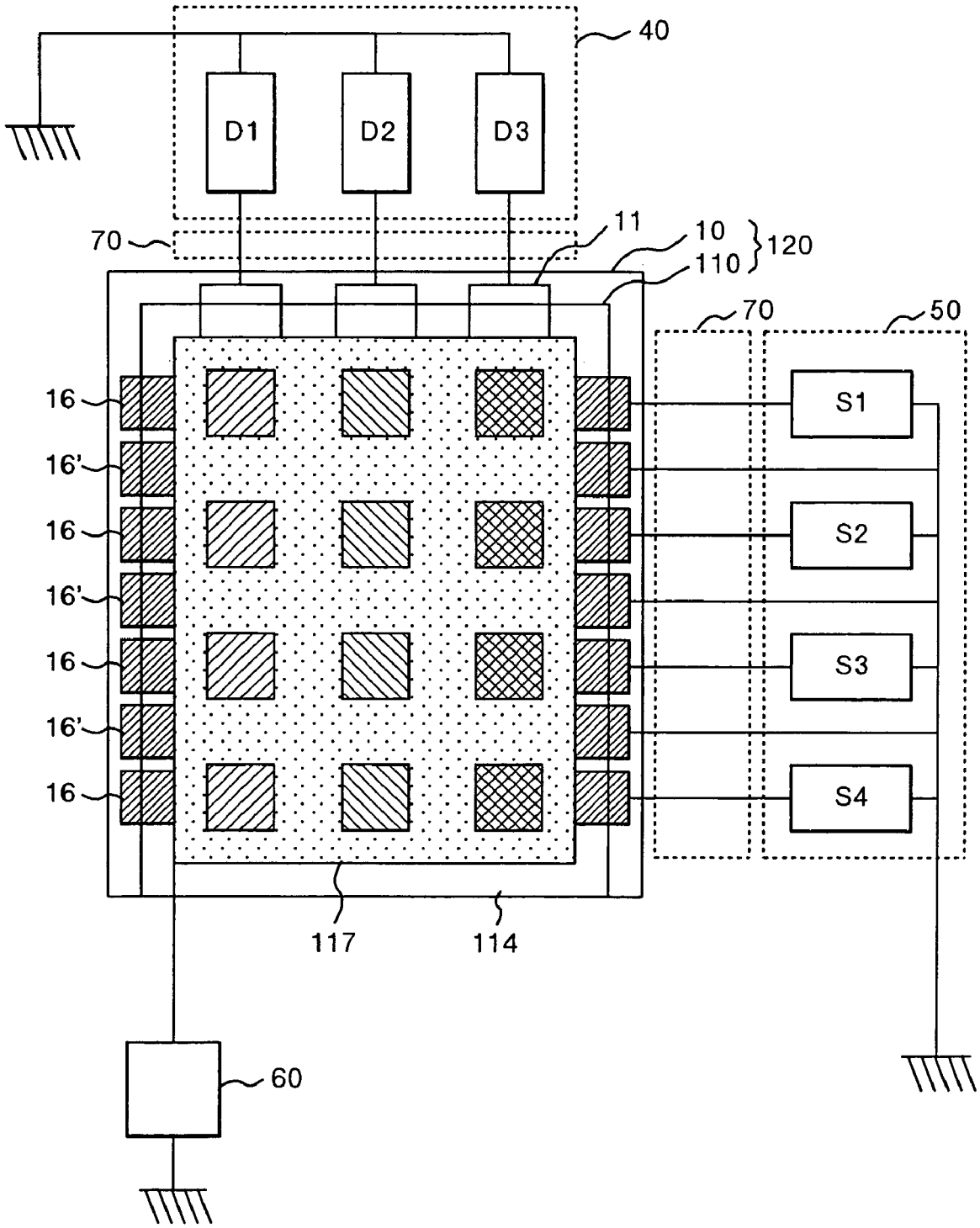
FIG. 32 is a plan view of a display device schematically illustrating the state of line-connection between a display panel 120 of the present invention and driver circuits.

FIG. 32 is a connection diagram wherein the display device panel 120 produced as described above is connected to driver circuits, and illustrates an outline of the whole of an electric circuit for driving the display device of the present example.

The bottom electrodes 11 set on the cathode substrate 10 are connected to a data line driver circuit 40 with an FPC 70, and the top electrode bus lines 16 are connected to a scan line driver circuit 50 with the FPC 70. In the data line driver circuit 40, data driver circuits D corresponding to the respective data lines 11 are arranged. In the scan line driver circuit 50, scan driver circuits S corresponding to the respective scan lines 16 are arranged.

The spacer lines 16' are connected to the scan data driver circuit 50 through the FPC 70, and ground voltage is given thereto inside the driver circuit.

An excellent point of this manner is that ground voltage is given to the spacers 30 through the spacer lines 16' at the same time of the connection of the scan lines 16.

The pixel positioned at the intersection point of the "m"th top electrode bus line (scan line) 16 and the "n"th bottom electrode (data line) 11 is represented by the coordinate (m, n). A high voltage of about 1 to 10 kV is applied to the metal back 114 from the high-voltage generating circuit 60.

As illustrated in FIG. 32, in the present example, it is supposed that the scan lines 16 and the data lines 11 are driven from one side of the cathode substrate 10. However, to arrange driver circuits on both sides thereof as the need arises does not prohibit the present invention from being realized.

Figure 33:
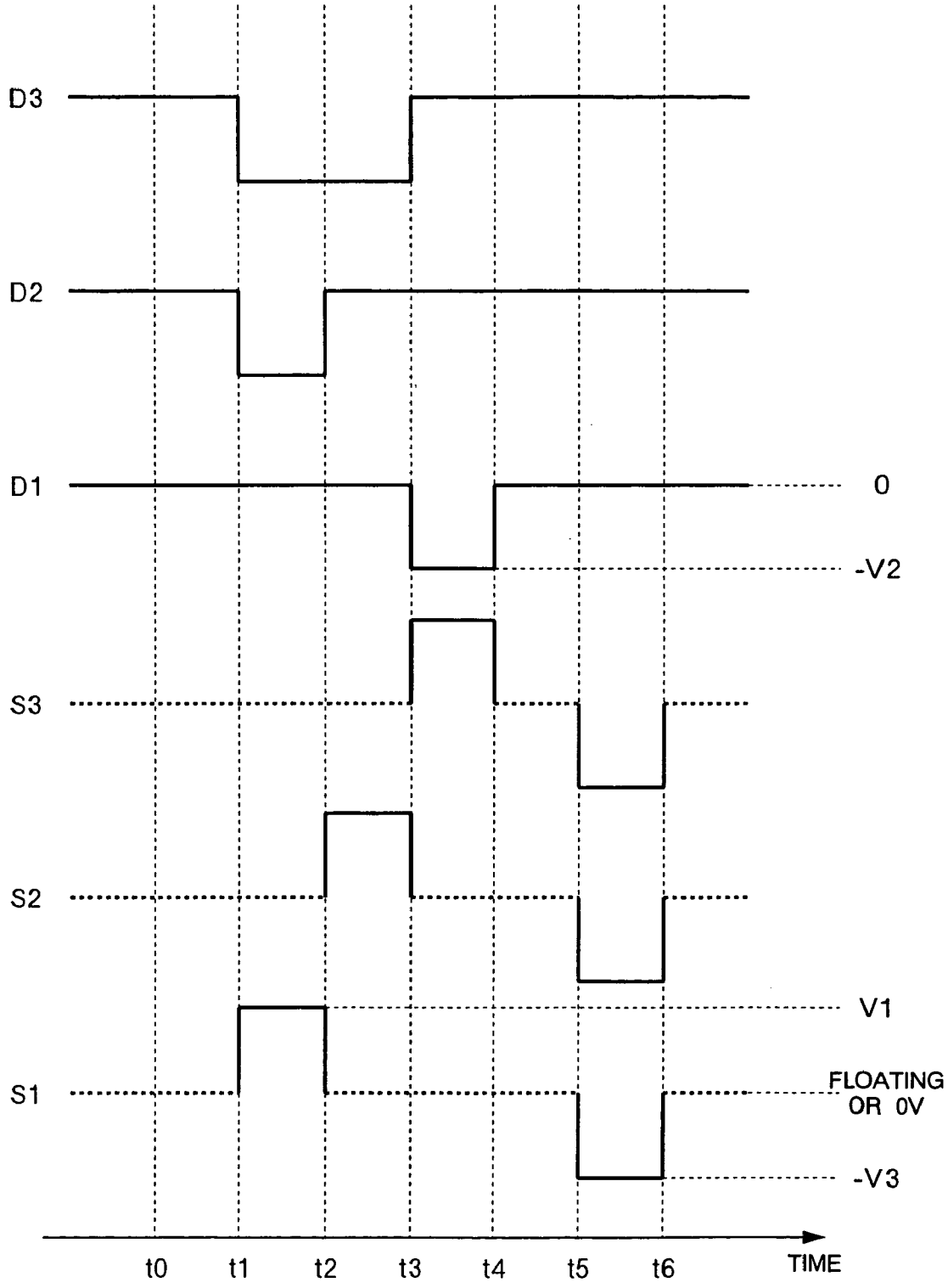
FIG. 33 is a diagram showing driving voltage waveforms in the display device of the present invention.

FIG. 33 illustrates an example of generated voltage waveforms in the respective driver circuits.

At time t0, voltages at all of the electrodes are zero; therefore, no electrons are emitted so that the phosphors do not emit any light.

At time t1, voltage V1 is applied to only S1 out of the top electrode bus lines 16, and voltage −V is applied to D2 and D3 out of the bottom electrode lines 11. In the coordinates (1, 2) and (1, 3), voltage (V1+V2) is applied between the bottom electrode 11 and the top electrode bus line 16. For this reason, when voltage (V1+V2) is set to a value not less than electron emitting start voltage, electrons are emitted from these MIM type electron sources to vacuum. The emitted electrons are accelerated by the high voltage applied to the metal back 114 from the high-voltage generating circuit 60, and then radiated into the phosphors, so that light is emitted.

In the case that voltage V1 is applied to S2 out of the top electrode bus lines 16 and voltage −V2 is applied to D3 out of the bottom electrodes 11 similarly at time t2, the coordinate (2, 3) is switched on in the same manner so as to emit electrons. As a result, the phosphor on this electron source coordinate emits light.

As described above, desired images or data can be displayed by changing scan signals applied to the top electrode bus lines 16. Images having a gray scale can be displayed by changing the value of voltage −V2 applied to the bottom electrodes 11 appropriately.

At time t5, a reverse bias is applied in order to release charges accumulating in the tunneling insulator 12. In other words, voltage −V3 is applied to all of the top electrode bus lines 16 and simultaneously 0 V is applied to all of the bottom electrodes 11.

In the present example, the voltage at the scan lines which are not selected is set to 0 V (ground voltage). However, as described in Patent Document 3 (Japanese Patent Application laid-Open No. 2001-83907), the use of the manner of cutting down reactive current, which follows charge-discharge, by keeping the non-selected scan lines in a high impedance state does not prohibit the present invention from being realized.

Example 2

This example discloses a manner that ground voltage is applied to the spacer lines 16' without being passed through the scan line driver circuit 50. First, according to Example 1, the cathode substrate 10 comprising MIM electron sources, the anode substrate 110 and the panel 120 are formed.

Figure 34:
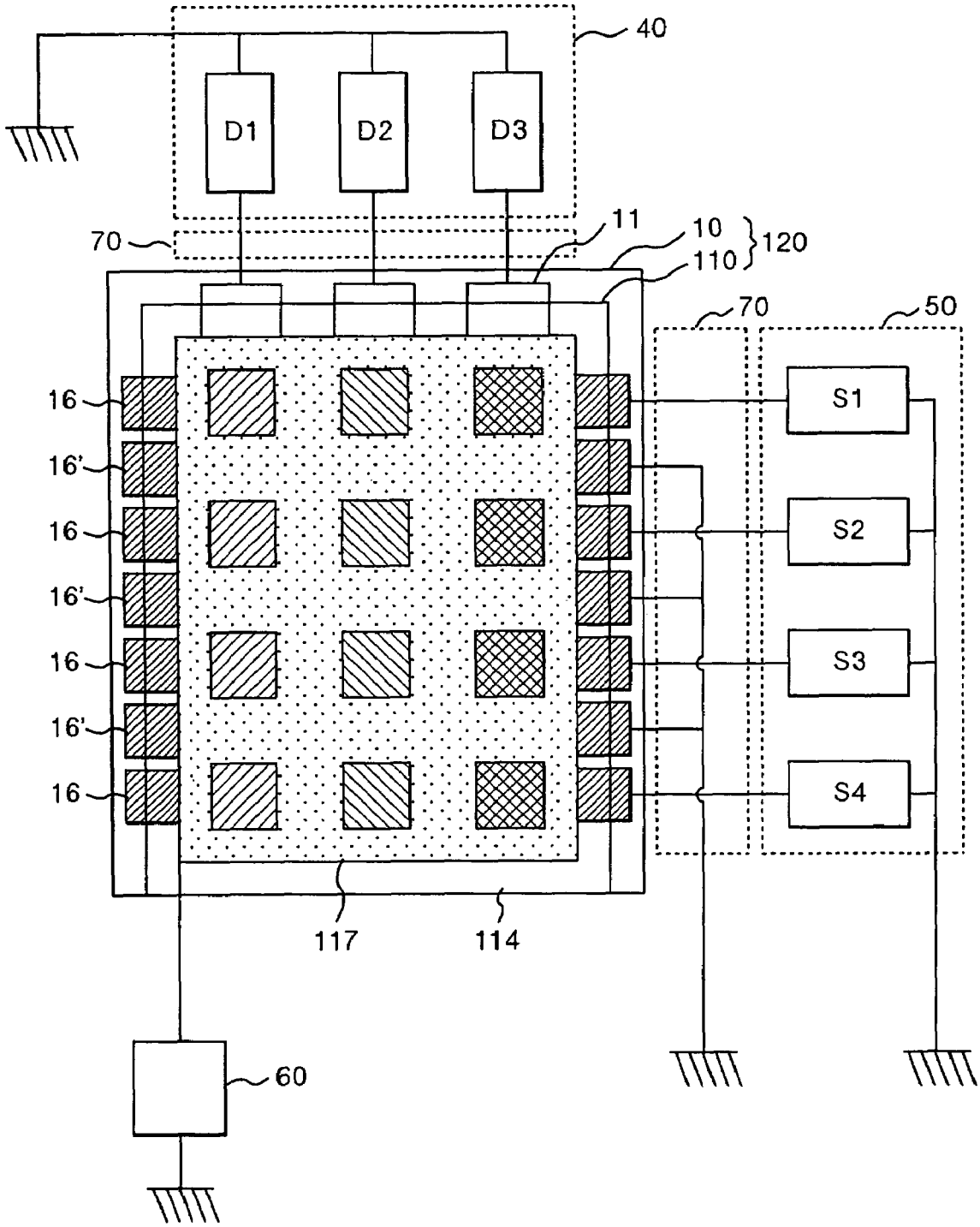
FIG. 34 is a plan view of a display device schematically illustrating the state of line-connection between a display panel 120 of the present invention and driver circuits.

FIG. 34 is a connection diagram illustrating the display device panel 120, which is formed as described above, connected to driver circuits. The bottom electrodes 11 are connected to the data line driver circuit 40 through the FPC 70, and the top electrode bus lines 16 are connected to the scan line driver circuit 50 through the FPC 70.

In the same way, the spacer lines 16' are connected to the scan line driver circuit 50 through the FPC 70. The FPC 70 used herein is made up to a circuit having internal lines for short-circuiting all of the spacer lines 16' in advance. In a terminal portion of the FPC 70, the unified spacer lines are connected to a ground line independently of the scan line driver circuit 50.

An excellent point of this manner is that even if arc discharge is generated inside the panel 120 to apply a high voltage to the spacer lines 16', the effect thereof is not produced on the scan line driver circuit 50.

Example 3

This example discloses another manner that ground voltage is applied to the spacer lines 16' without being passed through the scan line driver circuit 50. First, according to Example 1, the cathode substrate 10 comprising MIM electron sources, the anode substrate 110 and the panel 120 are formed.

In this case, attention should be paid to the matter that in the cathode substrate 10 terminals of the spacer lines 16' are extended to the outside of the top electrode bus lines 16 so as to be mutually short-circuited, which is different from Example 2.

Figure 35:
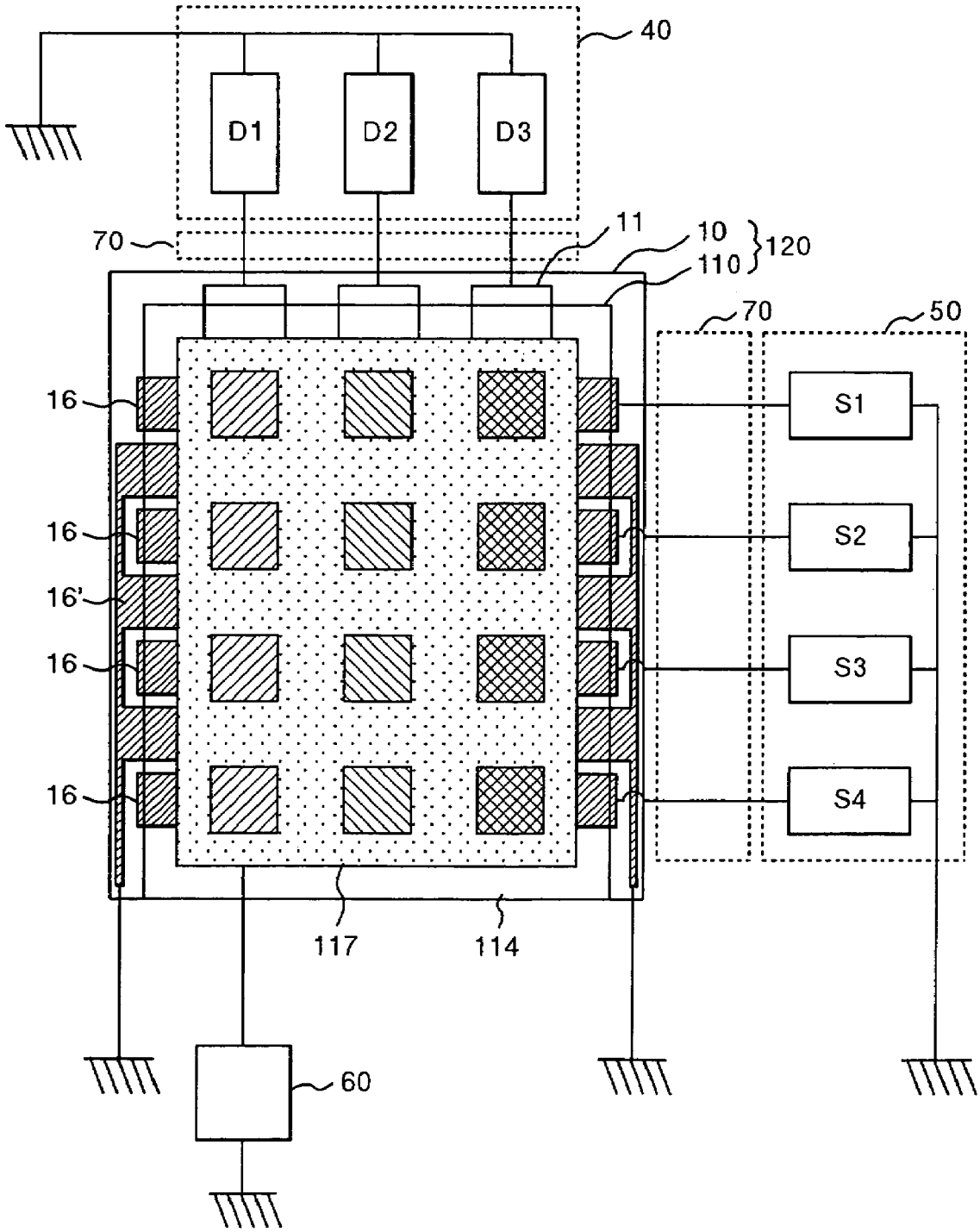
FIG. 35 is a plan view of a display device schematically illustrating the state of line-connection between the display panel 120 of the present invention and driver circuits.

FIG. 35 is a connection diagram illustrating the display device panel, which is formed as described above, connected to driver circuits. The bottom electrodes 11 are connected to the data line driver circuit 40 through the FPC 70, and the top electrode bus lines 16 are connected to the scan line driver circuit 50 through the FPC 70. The spacer lines 16' are unified at one end of the cathode substrate and on the cathode substrate, so as to be connected to independent ground lines.

An excellent point of this manner is that ground lines having a low impedance can be introduced without limitation based on the performance of the FPC 70. Consequently, even if arc discharge is generated inside the panel to apply a high voltage to the spacer lines 16', damage to the scan line driver circuit 50 can be completely avoided.

Example 4

An example according to the second aspect of the present invention will be described with reference to FIGS. 17 to 45.

(1) Formation of a Cathode Substrate 10:

This item describes a production process in a case in which top electrodes 13 are connected electrically to an underlying layer 15A and further top electrode bus lines 16 are backed with aluminum, aluminum alloy, or a metal having a lower resistivity than aluminum.

It is beforehand stated that the MIM electron source producing process which can be used in the present invention is not limited to the present example. The present invention can easily be applied to MIM electron sources disclosed in Patent Documents 1 and 2 (Japanese Patent Application Laid-Open Nos. 2001-101965 and 2000-208076), which comprise top electrode bus lines having a tapered structure, and other MIM electron sources.

Figure 36:
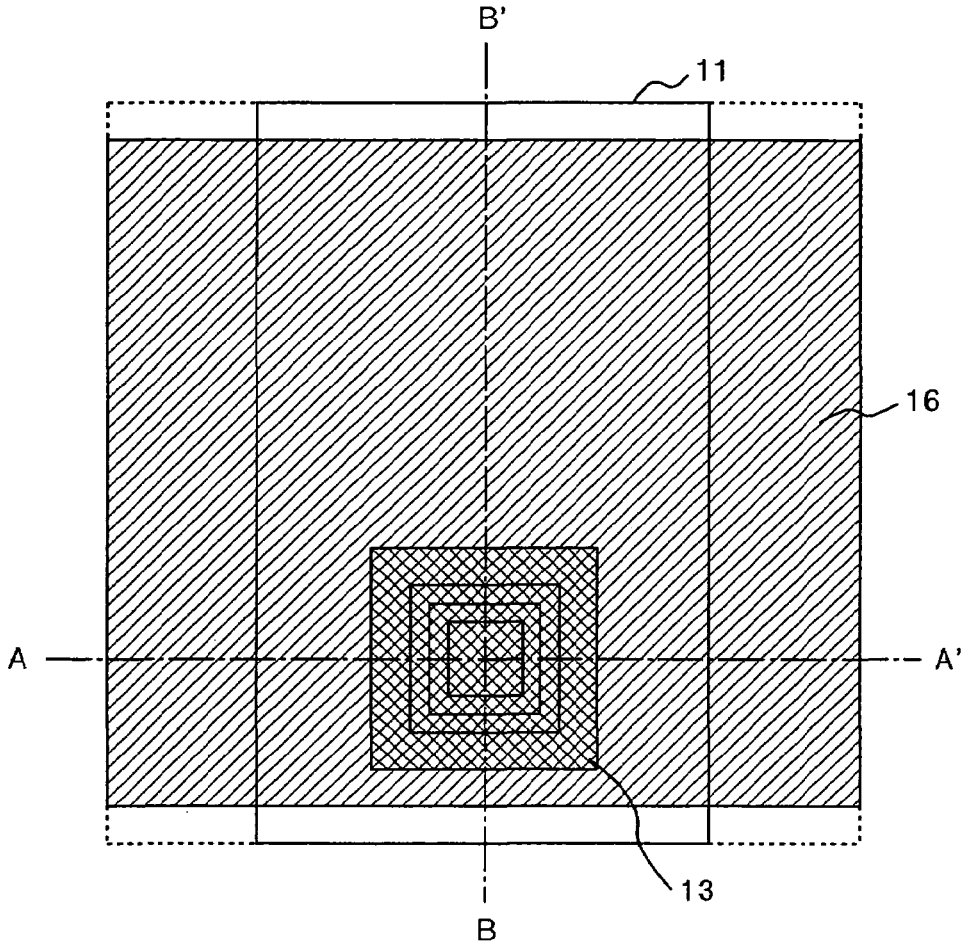
FIG. 36 is a plan view illustrating a different production process of the MIM type electron sources of the present invention.
Figure 37:
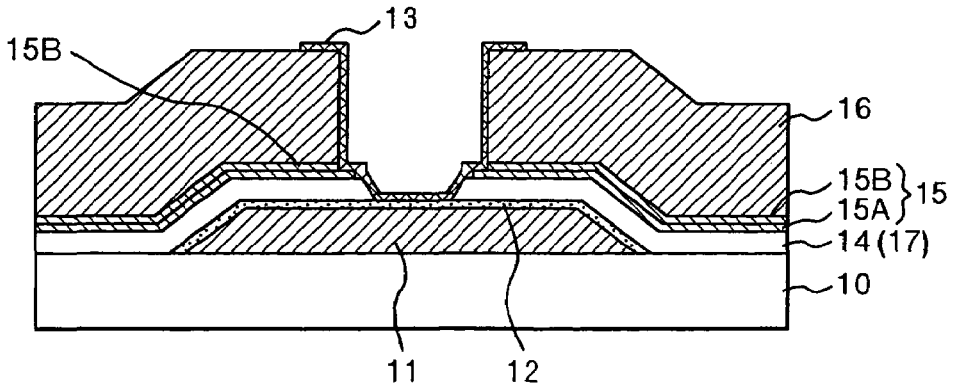
FIG. 37 is a sectional view illustrating the different production process of the MIM type electron sources of the present invention, taken on line A–A' of FIG. 36.
Figure 38:
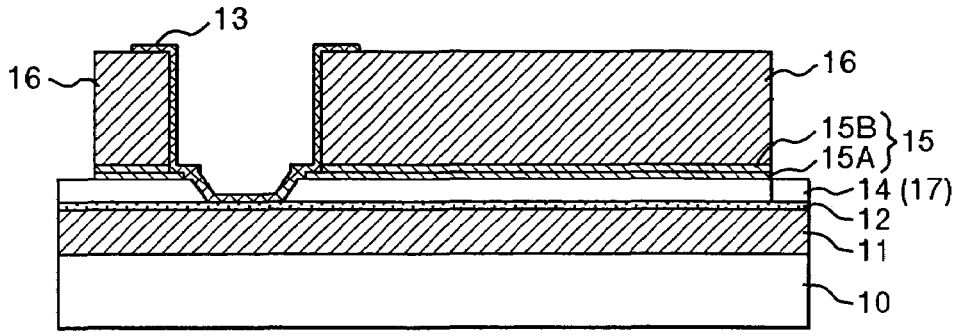
FIG. 38 is a sectional view illustrating the different production process of the MIM type electron sources of the present invention, taken on line B–B' of FIG. 36.

Electron sources are produced in accordance with the manner described in Example 1, as shown in FIGS. 3 to 8. The finished electron sources are illustrated in FIG. 36 (a plan view), FIG. 37 (a sectional view taken on line A–A'), and FIG. 38 (a sectional view taken on line B–B'). The electrical lines 16 and 16' positioned, as the upper layer, inside each of sub-pixels in Example 1 and illustrated in FIGS. 21, 22 and 23 are converted to one scan line 16 in this example and the width thereof is made two times wider so as to make the impedance thereof lower. In short, this example is characterized in that the spacer lines 16' and the scan lines 16 are made common. Consequently, the step of forming the top electrodes 16 is also made simpler than that in Example 1.

The reason why some parts of the scan lines 16 can be used both as the spacer lines 16' and scan lines without dividing the top electrode bus lines into the scan lines 16 and the spacer lines 16' by etching will be briefly described hereinafter.

The voltage applied to the scan lines 16 is usually as low as about 5 V, but the voltage applied to the metal back 14 of the finished anode substrate 110 (i.e., the acceleration voltage) is as high as 1 to 10 kV as described above. From this fact, the voltage applied to the scan lines 16 can be substantially regarded as ground voltage, as compared with the high voltage (acceleration voltage) applied to the metal back 114. In short, the scan lines can be regarded as spacer ground lines. Consequently, some parts of the scan lines 16 can be used both as the spacer lines 16' and scan lines without making the spacer lines independent.

Figure 39:
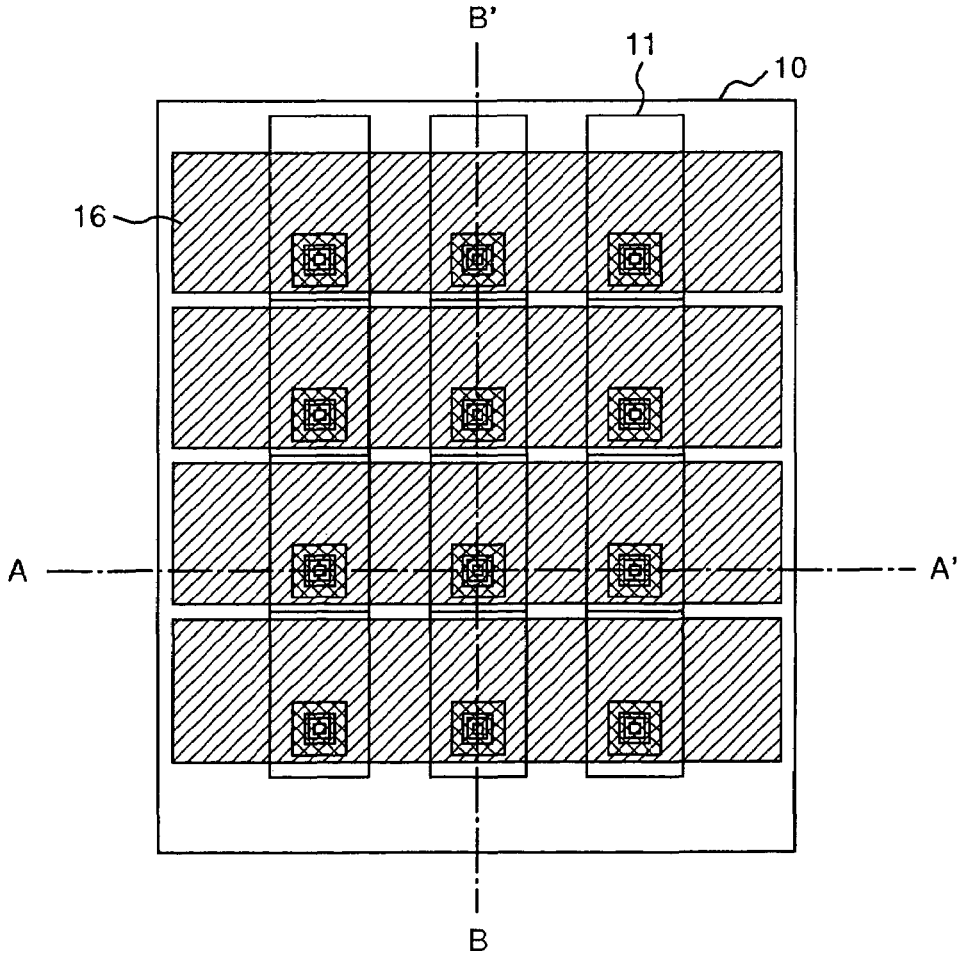
FIG. 39 is a plan view illustrating the production process of the cathode substrate 10, which is the different example of the present invention.
Figure 40:
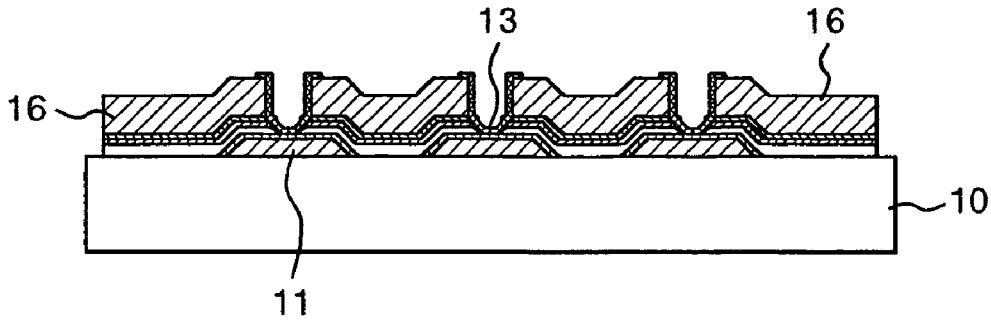
FIG. 40 is a sectional view illustrating the different example of the MIM type electron sources of the present invention, taken on line A–A' of FIG. 39.
Figure 41:
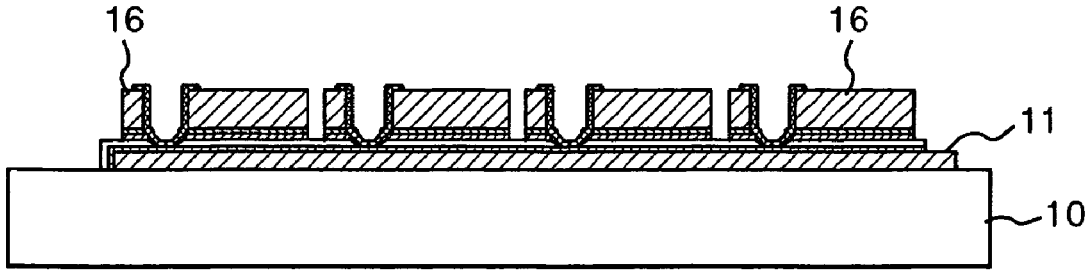
FIG. 41 is a sectional view illustrating the different example of the MIM type electron sources of the present invention, taken on line B–B' of FIG. 39.

The finished cathode substrate 10 wherein electron sources are arranged is schematically illustrated in FIG. 39 (a plan view), FIG. 40 (a sectional view taken on line A–A'), and FIG. 41 (a sectional view taken on line B–B'). To simplify the description hereinafter, the finished substrate 10 which is a 3×4 dot MIM type electron source substrate is illustrated. In any actual display panel, an MIM type electron source matrix wherein the number of MIM type electron sources corresponds to the number of display dots should be formed.

In the case that a display device is constructed, electrode ends of the bottom electrodes 11 and the top electrode bus lines 16 must be made naked in order to connect the ends to driver circuits although this matter has not been referred to, in the description on the process for producing the MIM type electron source, hereinbefore.

(2) Formation of the Anode Substrate 110:

The anode-substrate 110 wherein a phosphor surface is formed is formed in the manner as disclosed in Example 1.

Figure 42:
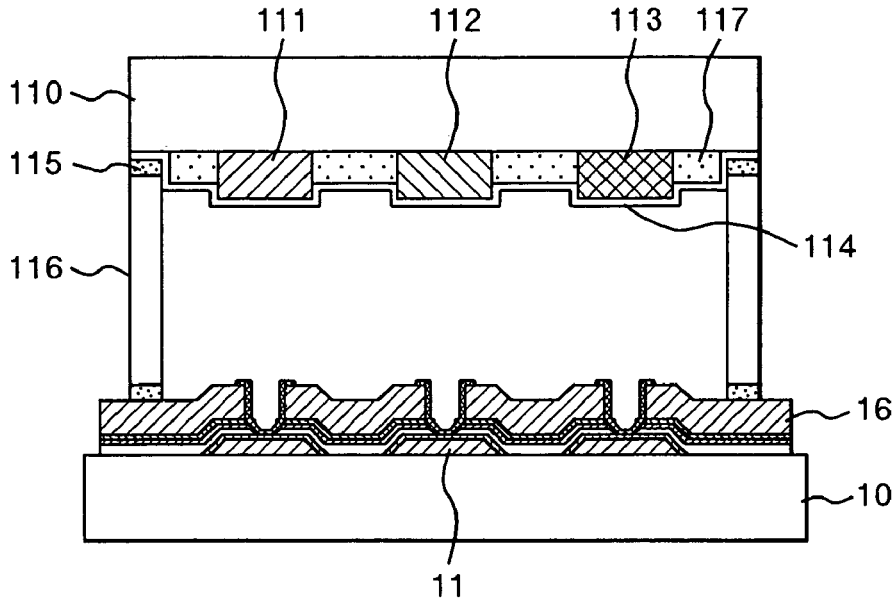
FIG. 42 is a sectional view illustrating the production process of the display device, which is the different example using the MIM type electron sources of the present invention, taken on line A–A'.
Figure 43:
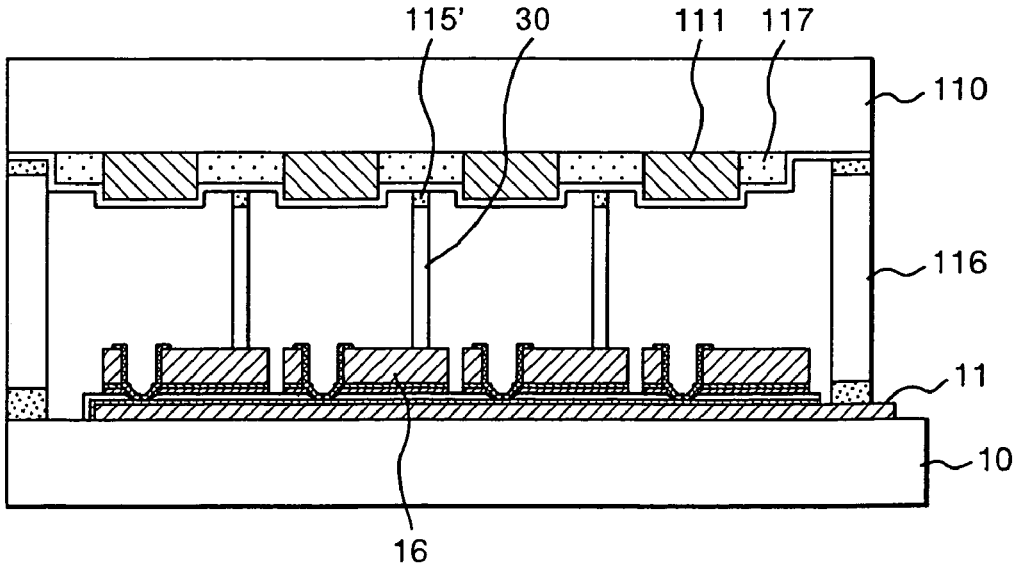
FIG. 43 is a sectional view illustrating the production process of the display device, which is the different example using the MIM type electron sources of the present invention, taken on line B–B'.

(3) Formation of a Display Panel:

Sections of the display panel 120 in the state that the finished anode substrate 110 and the above-mentioned cathode substrate 10 are adhered to each other are illustrated in FIG. 42 (a sectional view taken on line A–A') and 43 (a sectional view taken on line B–B'). These sectional views taken on line A–A' and line B—B correspond to line A–A' and line B–B' in cases where the cathode substrate 10 and the anode substrate 110 are drawn, respectively.

The spacers 30 are connected to some parts of the upper portions of the scan lines 16 (so as to avoid the electron emission area).

Figure 44:
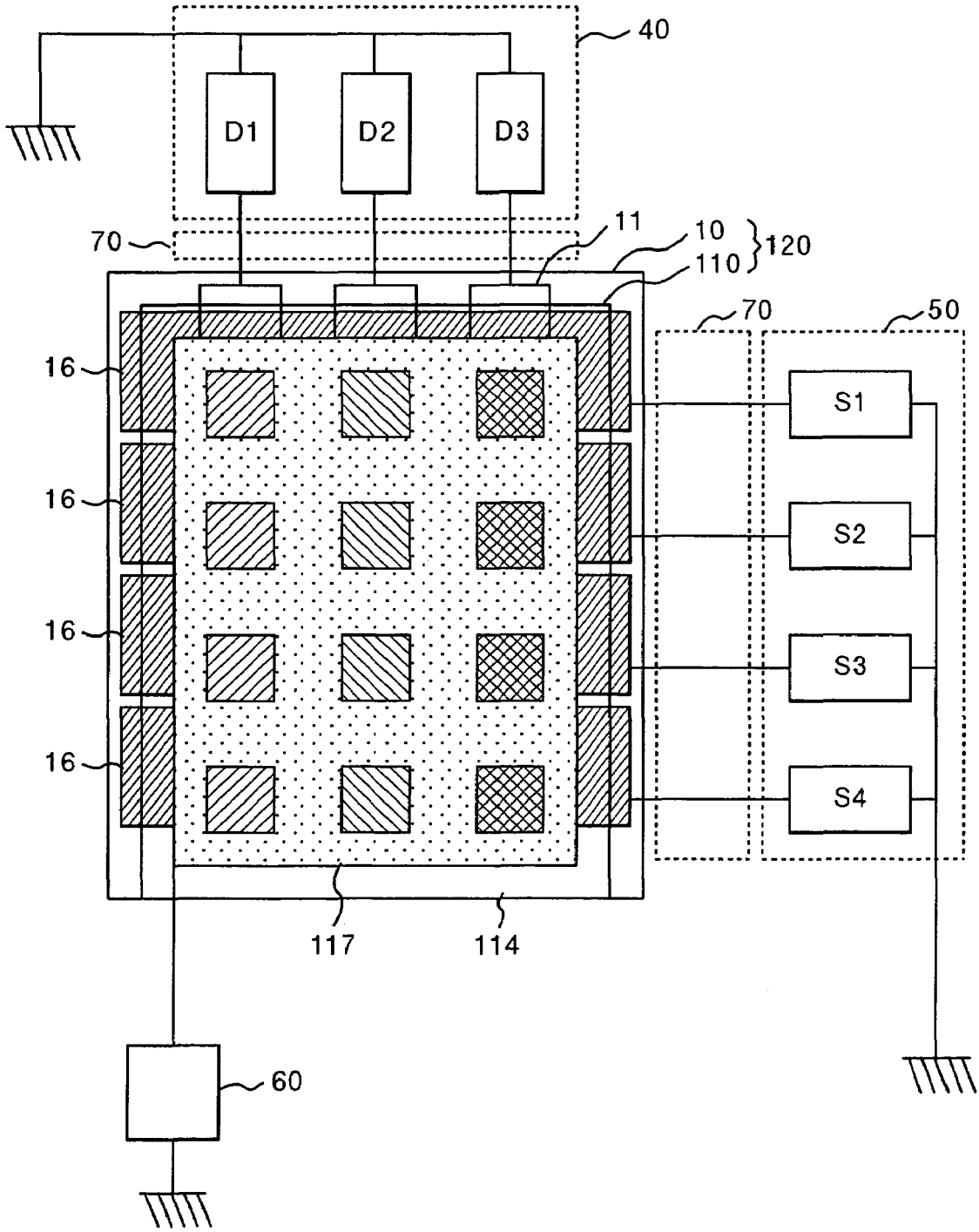
FIG. 44 is a plan view of a display device schematically illustrating the state of line-connection between the display panel 120, which is the different example of the present invention, and driver circuits.

FIG. 44 schematically illustrates the state that this display panel 120 is connected to driver circuits. As described above, the lower ends of the spacers 30 are connected to the scan lines 16, and the scan lines 16 are connected to the scan line driver circuit 50 through the FPC 70.

Figure 45:
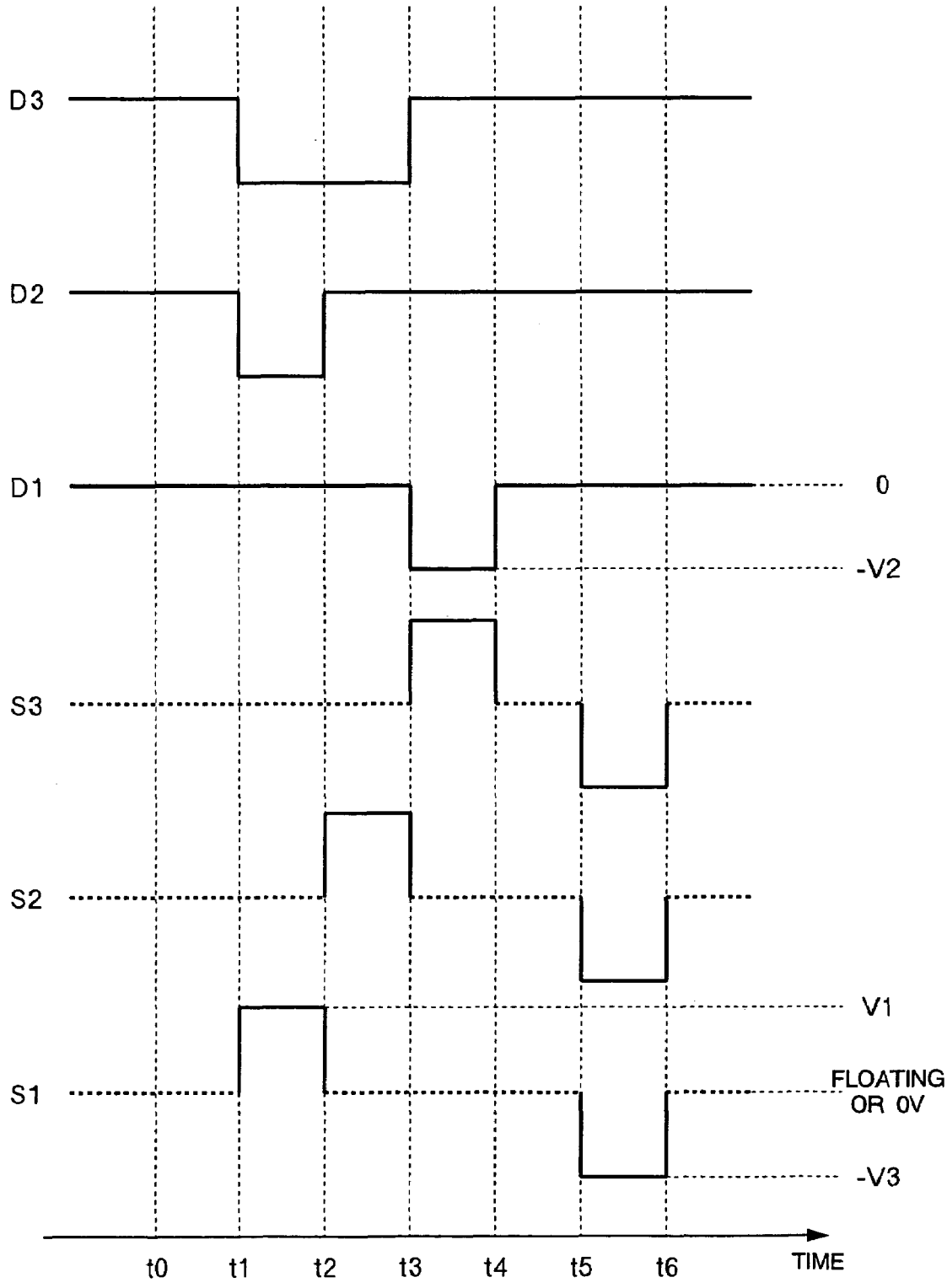
FIG. 45 is a diagram illustrating driving voltage waveforms in the display device which is the different example of the present invention.
Figure 46:
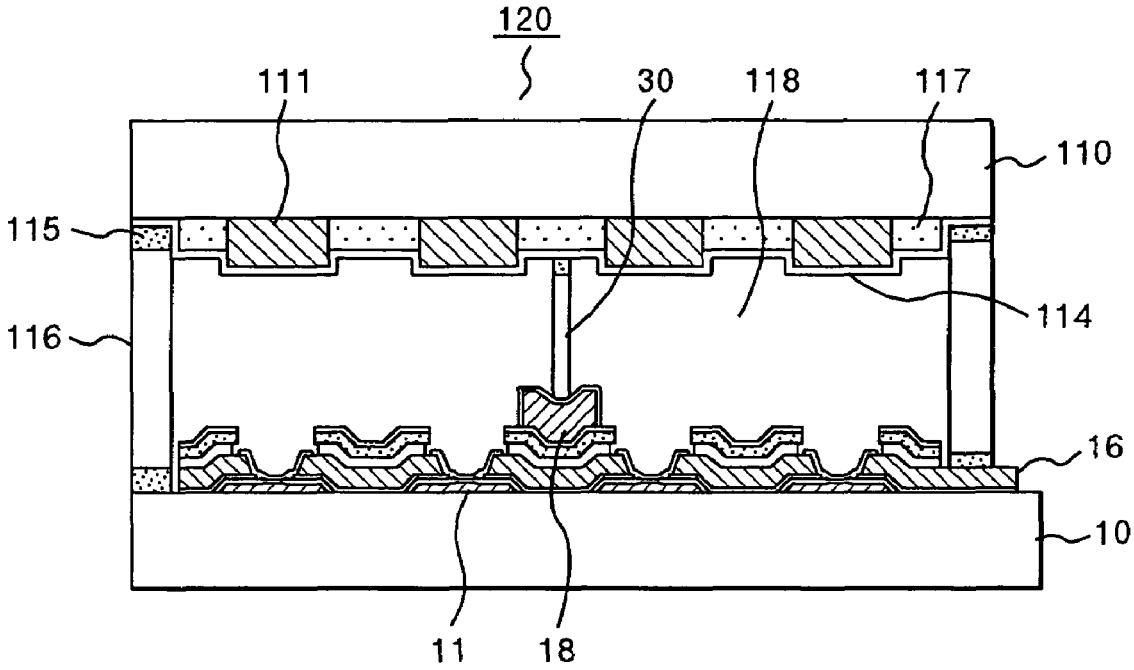
FIG. 46 is a sectional viewing illustrating a display panel using an MIM type electron source in order to describe the prior art.

FIG. 45 shows driving voltage waveforms when the display panel 120 produced in the present example is connected to the driver circuits as illustrated in FIG. 44 and driven. Basically, this figure is the same as FIG. 33 illustrating Example 1. In the present example, however, there are no independent spacer lines 16', and at the time of selecting a given scan line out of the scan lines 16 (selecting the electron source at a given coordinate), scan line voltage V1 is applied through the scan line beneath the lower end of the spacer. This point is different form Example 1.

Needless to say, when the electron source at a given coordinate is selected by selecting a given line out of the scan lines, electrons are emitted from the electron emission area of this selected electron source. As a result, the spacers adjacent to the electron source are charged up. Thus, in the present example, the voltage of the spacers 30 is fixed to a lower voltage (scan line voltage) than the anode voltage (the acceleration voltage applied to the metal back 114 of the anode substrate 110) at the least in the period when the electrons are emitted, whereby the electrification of the spacers can be removed by the surface conduction of the spacers. It is important for suppressing distortion of the orbit of the electrons or creeping discharge to prevent the electrification of the spacers 30.

In the case of the present example, the scan line voltage is as low as about 5 V while the anode voltage is as high as about 1 to 10 kV. Therefore, the voltage of the spacer 30 connected to this scan line substantially becomes ground voltage, so that the electrification can be sufficiently prevented.

When this scan line is not selected, reactive current following charge-discharge can be cut off by keeping the scan line, the voltage of which is usually fixed to 0 V, in a high impedance state, as described in Patent Document 3 (Japanese Patent Application Laid-Open No. 2001-83907). The use of this manner does not prohibit the present invention from being realized.

As described above, the desired objects can be attained by the present invention. In other words, in the step of producing a cathode substrate having two-layer lines, the second lines are caused to function both as scan lines and spacer (ground) lines, whereby ground lines for the spacers can be set up without increasing the number of lines. As a result, the production process can be shortened and a high yield can be attained so that costs can be reduced.

What is claimed is:

1. A cold cathode type flat panel display which is an image display device comprising a vacuum panel container composed of a cathode substrate in which plural cold cathode type electron sources are arranged at regular intervals, an anode substrate in which a phosphor film is deposited in the form of dots or lines so as to be opposed to the electron sources, plural spacers for supporting the cathode substrate and the anode substrate at a given interval, and a glass frame for keeping vacuum, plural electrical lines which extend in a line direction and a row direction which cross each other being formed, across an interlayer insulator, on the cathode substrate, the cold cathode type electron sources being arranged at positions corresponding to intersection coordinates of these electrical lines so as to be connected to the electrical lines in the line direction and the row direction, and the cold cathode type electron sources being line-sequentially scanned, thereby displaying images, wherein some parts of lines positioned in an upper layer out of the plural electrical lines are made into scan lines and lines positioned in a lower layer out of the plural electrical lines are made into data lines, and wherein some parts of the electrical lines positioned in the upper layer are made into ground lines for giving ground voltage to the spacers, and further the spacers are in a ground state by the ground lines at the least in a period when the scan lines adjacent thereto are selected.

2. The cold cathode type flat panel display according to claim 1, in which the spacer lines in the edge portion of the cathode substrate are extended to the outside of terminals of the scan lines and are mutually short-circuited, and the spacer lines give ground voltage from the outside through independent power feeding lines.

3. The cold cathode type flat panel display according to claim 1, in which in an edge portion of the cathode substrate, terminals of the electrical lines positioned in the upper layer are connected to a flexible printed circuit connected to a scan line driver circuit, and supply electric potential to the spacer lines through the scan line driver circuit.

4. The cold cathode type flat panel display according to claim 1, in which in an edge portion of the cathode substrate, terminals of the electrical lines positioned in the upper layer are connected to a flexible printed circuit connected to a scan line driver circuit, and supply ground voltage from the outside through independent power feeding lines in the state that the spacer lines are mutually short-circuited through internal lines of the flexible printed circuit.

5. A cold cathode type flat panel display which is an image display device comprising a vacuum panel container composed of a cathode substrate in which plural cold cathode type electron sources are arranged at regular intervals, an anode substrate in which a phosphor film is deposited in the form of dots or lines so as to be opposed to the electron sources, plural spacers for supporting the cathode substrate and the anode substrate at a given interval, and a glass frame for keeping vacuum, plural electrical lines which extend in a line direction and a row direction which cross each other being formed, across an interlayer insulator, on the cathode substrate, the cold cathode type electron sources being arranged at positions corresponding to intersection coordinates of these electrical lines so as to be connected to the electrical lines in the line direction and the row direction, and the cold cathode type electron sources being line-sequentially scanned, thereby displaying images, wherein lines positioned in an upper layer out of the plural electrical lines are made into scan lines and lines positioned in a lower layer out of the plural electrical lines are made into data lines, and wherein some parts of the scan lines positioned in the upper layer function both as power feeding lines for giving electric potential to the spacers and scan lines, and are at scan line voltage at the least in a period when the parts of the scan lines are selected.

* * * * *